US009267303B1

(12) United States Patent
Goettl

(10) Patent No.: US 9,267,303 B1
(45) **Date of Patent: *Feb. 23, 2016**

(54) POOL CLEANING SYSTEM WITH INCREMENTAL PARTIAL ROTATING HEAD

(71) Applicant: GSG Holdings, Inc., Chandler, AZ (US)

(72) Inventor: John M. Goettl, Phoenix, AZ (US)

(73) Assignee: GSG Holdings, Inc., Chandler, AZ (US)

( * ) Notice: Subject to any disclaimer, the term of this patent is extended or adjusted under 35 U.S.C. 154(b) by 291 days.

This patent is subject to a terminal disclaimer.

(21) Appl. No.: 14/029,654

(22) Filed: Sep. 17, 2013

Related U.S. Application Data

(63) Continuation-in-part of application No. 12/972,268, filed on Dec. 17, 2010, now Pat. No. 8,533,874, which is a continuation-in-part of application No. 12/912,691, filed on Oct. 26, 2010, now Pat. No. 8,308,081, which is a continuation-in-part of application No. 12/100,135, filed on Apr. 9, 2008, now Pat. No. 7,819,338, and a continuation-in-part of application No. 11/924,400, filed on Oct. 25, 2007, now Pat. No. 7,979,924, said application No. 12/972,268 is a continuation-in-part of application No. 11/926,515, filed on Oct. 29, 2007, now abandoned, which is a continuation-in-part of application No. 11/675,235, filed on Feb. 15, 2007, now abandoned.

(51) Int. Cl.
*E04H 4/00* (2006.01)
*E04H 4/16* (2006.01)

(52) U.S. Cl.
CPC . *E04H 4/169* (2013.01); *E04H 4/00* (2013.01)

(58) Field of Classification Search
CPC ..... E04H 4/169
USPC ..... 4/488–513
See application file for complete search history.

(56) References Cited

U.S. PATENT DOCUMENTS

| | | | |
|---|---|---|---|
| 935,201 | A | 9/1909 | Hallauer |
| 1,821,579 | A | 9/1931 | Rader |
| 1,964,269 | A | 6/1934 | Munz |
| 2,209,961 | A | 8/1940 | De Lacy-Mulhall |
| 2,214,852 | A | 9/1940 | De Lacy-Mulhall |
| 2,537,904 | A | 1/1951 | McAllister |
| 3,045,829 | A | 7/1962 | Rule et al. |
| 3,059,243 | A | 10/1962 | Ross |
| 3,237,866 | A | 3/1966 | Lovell |
| 3,245,420 | A | 4/1966 | Cherney |
| 3,247,968 | A | 4/1966 | Miller |
| 3,247,969 | A | 4/1966 | Miller |
| 3,408,006 | A | 10/1968 | Stanwood |

(Continued)

*Primary Examiner* — Lori Baker
(74) *Attorney, Agent, or Firm* — Booth Udall Fuller, PLC

(57) ABSTRACT

A pool cleaning system, method of designing a pool cleaning system and method of making a pool cleaning system comprising origin cleaning heads, transition cleaning heads and debris capture zones. Transition heads comprising net water flow vectors may be positioned to establish net water flow in the direction of one or more debris capture zones. Transition heads may comprise incrementally rotating pool cleaning head assemblies or a recessed incrementally rotating nozzle assembly configured to establish the net water flow. Cleaning head structure may comprise a slidably rotatable reverser between upper and lower portions of a cam assembly, the slidably rotatable reverser adjustable between first and second positions such that an incrementally rotating stem slidably mounted to the cam assembly incrementally rotates clockwise when the reverser is in its first position and counter clockwise when the reverser is in its second position.

20 Claims, 23 Drawing Sheets

(56) References Cited

U.S. PATENT DOCUMENTS

| | | | | |
|---|---|---|---|---|
| 3,449,772 | A | 6/1969 | Werner | |
| 3,486,623 | A | 12/1969 | Bosico | |
| 3,506,489 | A | 4/1970 | Baker | |
| 3,515,351 | A | 6/1970 | Costa | |
| 3,521,304 | A | 7/1970 | Ghiz | |
| 3,615,013 | A | 10/1971 | Reece | |
| 3,675,252 | A | 7/1972 | Ghiz | |
| 3,688,907 | A | 9/1972 | Oravec | |
| 3,712,470 | A | 1/1973 | Gansloser | |
| 3,765,608 | A | 10/1973 | Lockwood | |
| 3,769,993 | A | 11/1973 | Schaffer | |
| 3,955,764 | A | 5/1976 | Phaup | |
| 4,114,206 | A | 9/1978 | Franc | |
| 4,188,673 | A | 2/1980 | Carter | |
| 4,193,870 | A | 3/1980 | Goodin | |
| 4,195,371 | A | 4/1980 | Goodin | |
| 4,200,230 | A | 4/1980 | Gould | |
| 4,202,499 | A | 5/1980 | Mathews | |
| 4,212,088 | A | 7/1980 | Goettl | |
| 4,271,541 | A | 6/1981 | Mathews | |
| 4,276,163 | A | 6/1981 | Gordon | |
| 4,322,860 | A | 4/1982 | Gould | |
| 4,330,412 | A | 5/1982 | Frederick | |
| 4,347,979 | A | 9/1982 | Mathews | |
| 4,371,994 | A | 2/1983 | Mathews | |
| 4,391,005 | A | 7/1983 | Goettl | |
| 4,462,546 | A | 7/1984 | Pitman | |
| 4,466,142 | A | 8/1984 | Gould | |
| 4,471,908 | A | 9/1984 | Hunter | |
| 4,486,907 | A | 12/1984 | Carter | |
| 4,503,573 | A | 3/1985 | Handzel | |
| 4,520,514 | A | 6/1985 | Johnson | |
| 4,568,024 | A | 2/1986 | Hunter | |
| 4,592,379 | A | 6/1986 | Goettl | |
| 4,640,784 | A | 2/1987 | Cant | |
| 4,832,838 | A | 5/1989 | Stone | |
| 4,907,610 | A | 3/1990 | Meincke | |
| 4,939,797 | A | 7/1990 | Goettl | |
| 5,048,758 | A | 9/1991 | Jackerson | |
| 5,107,872 | A | 4/1992 | Meincke | |
| 5,135,579 | A | 8/1992 | Goettl | |
| 5,251,343 | A | 10/1993 | Goettl | |
| 5,265,631 | A | 11/1993 | Goettl | |
| 5,333,788 | A | 8/1994 | Hadar | |
| 5,826,797 | A | 10/1998 | Kah, III | |
| 6,029,907 | A | 2/2000 | McKenzie | |
| 6,085,995 | A | 7/2000 | Kah, Jr. et al. | |
| 6,182,909 | B1 | 2/2001 | Kah, Jr. et al. | |
| 6,237,862 | B1 | 5/2001 | Kah, III et al. | |
| 6,301,723 | B1 | 10/2001 | Goettl | |
| 6,367,098 | B1 | 4/2002 | Barnes | |
| 6,393,629 | B1 | 5/2002 | Barnes et al. | |
| 6,419,840 | B1 | 7/2002 | Meincke | |
| 6,438,766 | B1 | 8/2002 | Arnau | |
| 7,819,338 | B1 * | 10/2010 | Goettl | E04H 4/169 239/204 |
| 7,979,924 | B1 * | 7/2011 | Goettl | E04H 4/169 239/236 |
| 8,308,081 | B1 * | 11/2012 | Goettl | E04H 4/169 239/204 |
| 8,533,874 | B1 * | 9/2013 | Goettl | E04H 4/169 134/167 R |
| 2004/0194201 | A1 | 10/2004 | Goettl | |

* cited by examiner

POOL CLEANING SYSTEM WITH INCREMENTAL PARTIAL ROTATING HEAD

CROSS REFERENCE TO RELATED APPLICATIONS

This application is a continuation-in-part application of the earlier U.S. Utility Application to Goettl entitled "Pool Cleaning System with Incremental Partial Rotating Head," application Ser. No. 12/972,268, filed Dec. 17, 2010 and issuing as U.S. Pat. No. 8,533,874 on Sep. 17, 2013, which is a continuation-in-part application of the earlier U.S. Utility Application to Goettl entitled "Cam Operated Swimming Pool Cleaning Nozzle," application Ser. No. 12/912,691, filed Oct. 26, 2010, now U.S. Pat. No. 8,308,081, issued Nov. 13, 2012, which is a continuation-in-part application of the earlier U.S. Utility Application to Goettl entitled "Cam Operated Swimming Pool Cleaning Nozzle," application Ser. No. 12/100,135, filed Apr. 9, 2008, now U.S. Pat. No. 7,819,338, issued Oct. 26, 2010, the disclosures of which are hereby incorporated entirely herein by reference. Application Ser. No. 12/912,691 is also a continuation-in-part of the earlier U.S. Utility Application to Goettl entitled "Cam Operated Swimming Pool Cleaning Nozzle," application Ser. No. 11/924,400, filed Oct. 25, 2007, now U.S. Pat. No. 7,979,924, the disclosures of which are hereby incorporated entirely herein by reference.

The Ser. No. 12/972,268 application is also a continuation-in-part application of the earlier U.S. Utility Application to Goettl entitled "Pool Debris Removal and Design Method," application Ser. No. 11/926,515, filed Oct. 29, 2007, now abandoned, which is a continuation-in-part of the earlier U.S. Application to Goettl entitled "Method for Channeling Debris in a Pool," application Ser. No. 11/675,235, filed Feb. 15, 2007, now abandoned, the disclosures of which are hereby incorporated entirely herein by reference.

BACKGROUND

1. Technical Field

Aspects of this document relate generally to cleaning nozzles for swimming pools and pool cleaning systems.

2. Background Art

Pool cleaning systems are used in swimming pools to remove dirt and debris from the water in the swimming pool. Various methods for removing debris from the pool include the use of "whips" extending from various location on the side walls or nozzles in the side walls or floor surface to stir up debris for pumping to the pool filter. Conventional cleaning nozzles for swimming pools utilize water pressure generated by a pool pump to direct a stream of water across a surface of the pool to entrain and move contaminants from the surface toward a drain. Many conventional cleaning nozzles "pop up" from a surface of a pool as the heads, normally level with the surface, are extended under the influence of water pressure from the pump. When the water pressure from the pump ends, the heads retract downward until level with the surface, conventionally in response to bias from a spring element contained within the cleaning nozzle.

SUMMARY

According to one aspect, a swimming pool cleaning head comprises a cam housing, a stem, a nozzle head, and a cleaning head assembly. The stem rotatably extends through the cam housing and comprises an outlet configured to eject an intermittent stream of water therethrough under water pressure force. The nozzle head is positionally coupled to the stem and positioned at least partially within the housing. The nozzle head comprises at least one of a reversing tab or a pin extending therefrom. The cleaning head assembly is positioned within the housing and at least partially around the stem. The cam assembly comprises a slidable section rotatable within the housing between a first extent and a second extent responsive to contact from reversing tab or pin. The nozzle head changes a direction of rotation responsive to rotation of the slidable section from the first extent to the second extent.

Various implementations and embodiments of the swimming pool cleaning head may comprise one or more of the following. The cam assembly may comprise an upper section, a lower section coupled to the upper section with the slidable section positioned between the upper section and the lower section, and a plurality of saw tooth members. The at least one pin is configured to incrementally rotate the stem and the nozzle head in a first direction in intermittent contact with the plurality of saw tooth members during vertical translation of the stem through water pressure force, and slidably rotate the rotatable section of the cam assembly from its first extent to its second extent. The cam assembly may be configured to automatically reverse the incremental rotation of the stem to a second direction opposite the first direction when the rotatable section of the cam assembly is rotated to its second extent. The upper section and the lower section of the cam assembly may be positionally coupled to one another such that they do not rotate with respect to each other. The upper section may comprise a plurality of saw tooth members and a reverser stop recess. The lower section may comprise a plurality of saw tooth members and a reverser stop recess aligned with the reverser stop recess of the upper section. The slidable section may comprise a plurality of saw tooth members, a reverser arm, and a reverser stop lug slidable within the aligned reverser stop recesses of the upper and lower sections between the first extent and the second extend. The nozzle head may comprise a first reverser tab and a second reverser each positioned to engage with the reverser arm, wherein when the first reverser tab engages the reverser arm the slidable section rotates to the first extent, and when the second reverser tab engages the reverser arm the slidable section rotates to the second extent. The second reverser tab may be removably coupled to the nozzle head and a degree of nozzle head rotation between the first extent and the second extent is adjustably dependent upon positioning of the second reverser tab. The first reverser tab may be removably coupled to nozzle head. A clamp ring coupled to the housing and configured to hold the cam assembly within the housing. One or more retainer installation lugs extending from the housing and positioned to selectively engage with body installation lugs of a body embedded in a pool surface to allow installation of the swimming pool cleaning head in only one direction. The degree of nozzle head rotation is adjustable between approximately 23 and 360 degrees.

According to another aspect, a swimming pool cleaning head assembly comprises a cam housing, a stem and a nozzle. The cam housing comprises a cam assembly within the cam housing. The cam assembly comprises an upper section comprising a first plurality of pin guides, a lower section positionally coupled to the upper section and comprising a second plurality of pin guides, and a slidable section positioned at least partially between the upper section and the lower section and comprising a third plurality of pin guides slidably mounted between the first plurality of pin guides and the second plurality of pin guides, the slidable section rotatable between a first extent and a second extent. The stem extends through the cam assembly. The nozzle head is positioned at least partially within the cam assembly. The nozzle heading comprises at least one pin slidably engaged within the cam assembly between the first plurality of pin guides and the second plurality of pin guides, wherein rotation of the slidable section alters a pin path of the at least one pin through the first, second, and third plurality of pin guides, and rotation of the slidable section from the first extent to the second extent reverser a direction of travel for the at least one pin along the pin path.

Various implementations and embodiments of the pool cleaning head assembly may comprise one or more of the following. The first plurality of pin guides may be formed between a first plurality of saw tooth members on the upper section, the second plurality of pin guides may be formed between a second plurality of saw tooth members on the lower section, and the third plurality of pin guides may be formed between a third plurality of saw tooth members on the slidable section. The at least one pin may be configured to incrementally rotate the stem in a first direction in intermittent contact with the first, second, and third pluralities of pin guides during vertical translation of the stem through water pressure force applied to the stem, and slidably rotate the rotatable section of the cam assembly from the first extent to the second extent. The upper section and lower section may each comprise a reverser stop recesses aligned with one another. The slidable section may comprise a reverser arm and a reverser stop lug, the reverser stop lug being positioned and slidable within the aligned reverser stop recesses between the first extent and the second extent. The nozzle head may comprise a first reverser tab and a second reverser each positioned to engage with the reverser arm, wherein when the first reverser tab engages the reverser arm the slidable section rotates to the first extent, and when the second reverser tab engages the reverser arm the slidable section rotates to the second extent. The second reverser tab may be removably coupled to the nozzle head and a degree of nozzle head rotation between the first extent and the second extent is adjustably dependent upon positioning of the second reverser tab. The first reverser tab may be removably coupled to nozzle head. A clamp ring may be coupled to the housing and configured to hold the cam assembly within the housing. The degree of nozzle head rotation may be adjustable between approximately 23 and 360 degrees.

According to another aspect, a swimming pool cleaning head assembly comprises a housing, a cam assembly, a stem, and a nozzle head. The cam assembly comprises an upper section, a lower section coupled to the upper section, and a slidable section positioned at least partially between the upper section and the lower section, the slidable section being slidable between a first extend and a second extent. The stem rotatably extends through the housing and at least partially into the cam assembly. The stem is configured to allow a water pressure force therethrough. The nozzle head is positionally coupled to the stem and comprises at least one pin engaged with the cam assembly, wherein the slidable section is slidable between the first extent and the second extent responsive to the at least one pin to change the direction of rotation of the nozzle head when the water pressure force is passing therethrough.

Various implementations and embodiments may comprise one or more of the following. The cam assembly may comprise a plurality of saw tooth members and the at least one pin is configured to incrementally rotate the stem in a first direction in intermittent contact with the plurality of saw tooth members during vertical translation of the stem through water pressure force, slidably rotate the rotatable section of the cam assembly from its first extent to its second extent, and automatically reverse the incremental rotation of the stem to a second direction opposite the first direction when the rotatable section of the cam assembly is rotated to its second extent. The upper section and lower section may each comprise a reverser stop recesses aligned with one another. The slidable section may comprise a reverser arm and a reverser stop lug, the reverser stop lug being positioned and slidable within the aligned reverser stop recesses between the first extent and the second extent. The nozzle head may comprise a first reverser tab and a second reverser each positioned to engage with the reverser arm, wherein when the first reverser tab engages the reverser arm the slidable section rotates to the first extent, and when the second reverser tab engages the reverser arm the slidable section rotates to the second extent, the second reverser tab being removably coupled to the nozzle head and a degree of nozzle head rotation being adjustable between the first extent and the second extent dependent upon positioning of the second reverser tab.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended nozzle assembly and/or assembly procedures for a nozzle assembly will become apparent for use with particular implementations from this disclosure. Accordingly, for example, although particular implementations are disclosed, such implementations and implementing components may comprise any shape, size, style, type, model, version, measurement, concentration, material, quantity, and/or the like as is known in the art for such nozzle assemblies and implementing components, consistent with the intended operation.

Structure.

Figure 9:
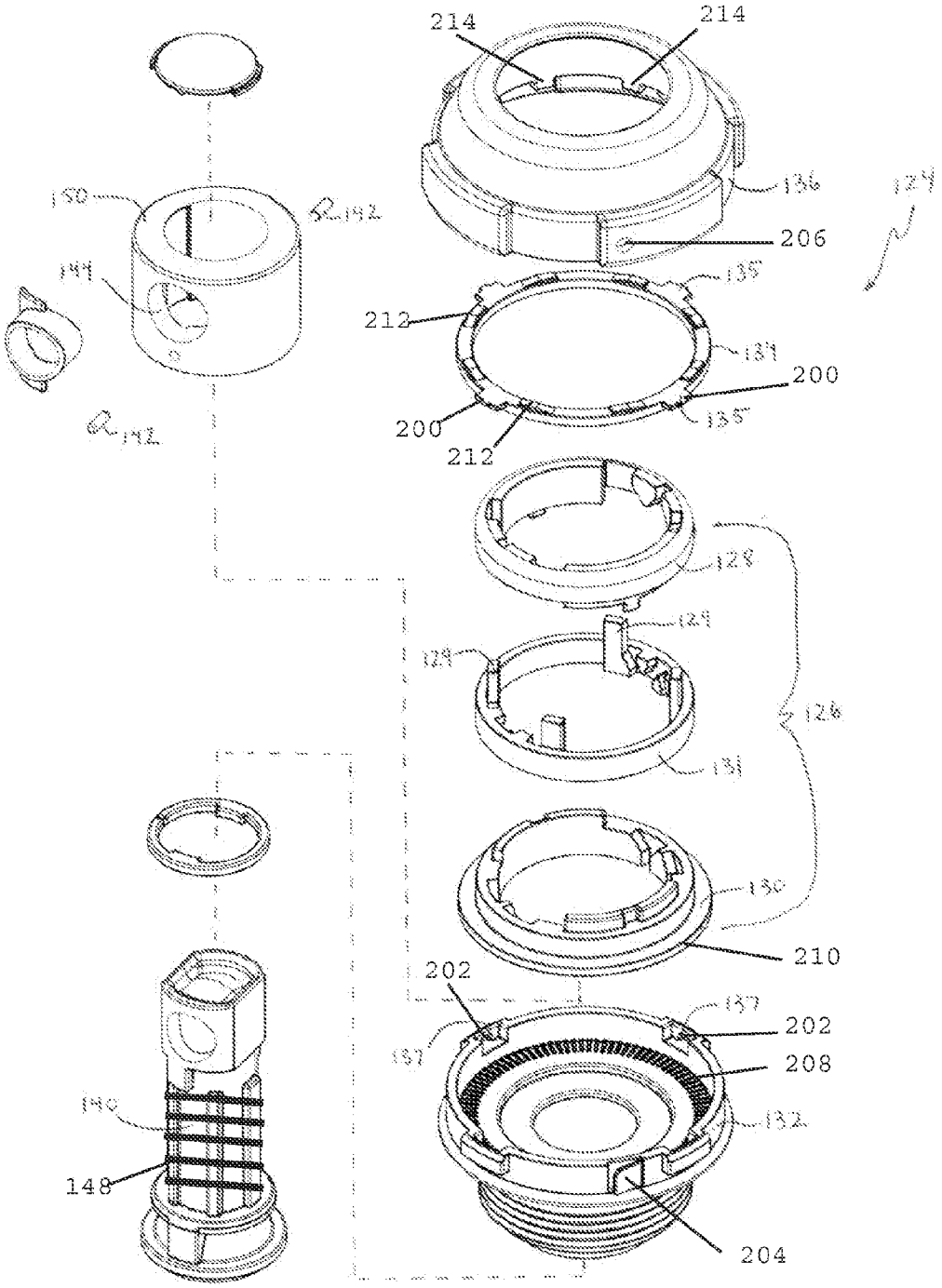
FIG. 9 is an exploded view of an implementation of a nozzle assembly.

Referring to FIG. 9, an exploded view of an implementation of a cleaning head assembly (alternatively called a nozzle assembly) 124 is illustrated. The cleaning head assembly 124 may include a cam assembly (alternatively called a cam ring) 126. As illustrated, in particular implementations the cam assembly 126 may include an upper section 128, a slidable section 131 (alternatively called a cam reverser), and a lower section 130. The slidable section 131 may include at least one shifter 129 that extends from the slidable section into the upper section 128. The cam assembly 126 may couple into a housing (alternatively called a body) 132. When coupled into the housing 132, a locking ring 134 may be coupled over the lower section 130 and includes lugs 135 that engage within locking features 137 in the housing 132. In particular implementations, the upper section 128 and lower section 130 of the cam assembly 126 may be fixedly coupled together through, by non-limiting example, a sonic weld, heat staking, adhesive or other method of fixedly coupling two plastic parts together. While the upper section 128 and lower section 130 are fixedly coupled together, the slidable section 131 remains slidably engaged between them and is free to move rotatably with respect to the upper and lower sections 128, 130, respectively.

The tips of the lugs 135, of the particular implementation shown in FIG. 9, are configured with prongs 200 that fit into the recesses 202 of the locking features 137 in the housing 132. Placement of the locking ring 134 over the cam assembly 126 in the lower section 130 holds the cam assembly 126 in place through mating of the prongs 200 with the recesses 202. In many cases, the strength of the engagement of the prongs 200 into the recesses 202 is strong enough that the up and down nozzle action in the cam assembly 126 so that the nozzle 140 may be tested without the cap ring 136 added. This allows an installer to rotationally adjust the cam assembly 126 in relation to the lower section 130 prior to locking all of the components in place with the cap ring 136. By rotationally adjusting the cam assembly 126 in relation to the lower section 130, the directional orientation of the nozzle 140 may be set regardless of the original orientation of the in-wall fitting for the nozzle assembly. In other words, even though the in-wall fitting for the nozzle assembly yields an unknown radial direction for the final nozzle housing, an installer can adjust the direction of the nozzle during installation to any orientation needed.

A cap ring 136 may be coupled over the cam assembly 126 against the locking ring 134. Use of the cap ring 136 may allow, in particular implementations, for the lower and upper sections 130, 128 of the cam assembly 126 to be rendered substantially immobile in relation to the housing 132 during operation of the cleaning head assembly 124 while leaving the slidable section 131 capable of rotational sliding motion. The cap ring 136 may be loosened or removed by pressing a locking arm 204 coupled to the housing 132 which is engaged with the cap ring 136 inwardly through an opening 206 in the cap ring 136 until the locking arm 204 disengages from the cap ring 136. The locking arm 204 is biased to a position that engages the cap ring 136. For example, the locking arm 204 may be formed of a flexible material that self-biases the locking arm 204. As another example, the locking arm 204 may be formed as a lever with a spring, or through other structures known in the art for manufacturing a biased arm.

As illustrated in FIG. 9, the ability of the cap ring 136 to render the lower and upper sections 128, 130 of the cam assembly 126 substantially immobile is aided, in particular implementations, by a plurality of ridges 208 distributed along the surface of the housing 132 that couple with the lower section 130 of the cam assembly 126. As illustrated, the lower section 130 includes a plurality of grooves 210 that couple with the plurality of ridges 208 of the housing 132 under compressive force created by the rotation of the cap ring 136. In particular implementations, the compressive force generated by the rotation of the cap ring 136 may be increased through a plurality of ramp members 212 extending from the locking ring 134 that engage with projections 214 of the cap ring 136 while it is rotated. As the cap ring 136 is rotated, the force on the locking ring 134 increases as the projections 214 engage with the ramp members 212, pressing the locking ring 134 against the lower section 130 of the cam assembly 126. As the force against the lower section 130 increases, the plurality of grooves 210 begin to increasingly engage with the plurality of ridges 208, thereby increasingly restricting the rotational motion of the lower section 130 until it is rendered substantially immobile. In particular implementations, once the cap ring 136 has been rotated sufficiently to render the lower section 130 immobile, the locking arm 204 may engage with the cap ring 136 to resist any unintentional loosening of the cleaning head assembly 124 thereby maintaining the positional relationship between the cam assembly 126 and the housing 132.

Figure 10:
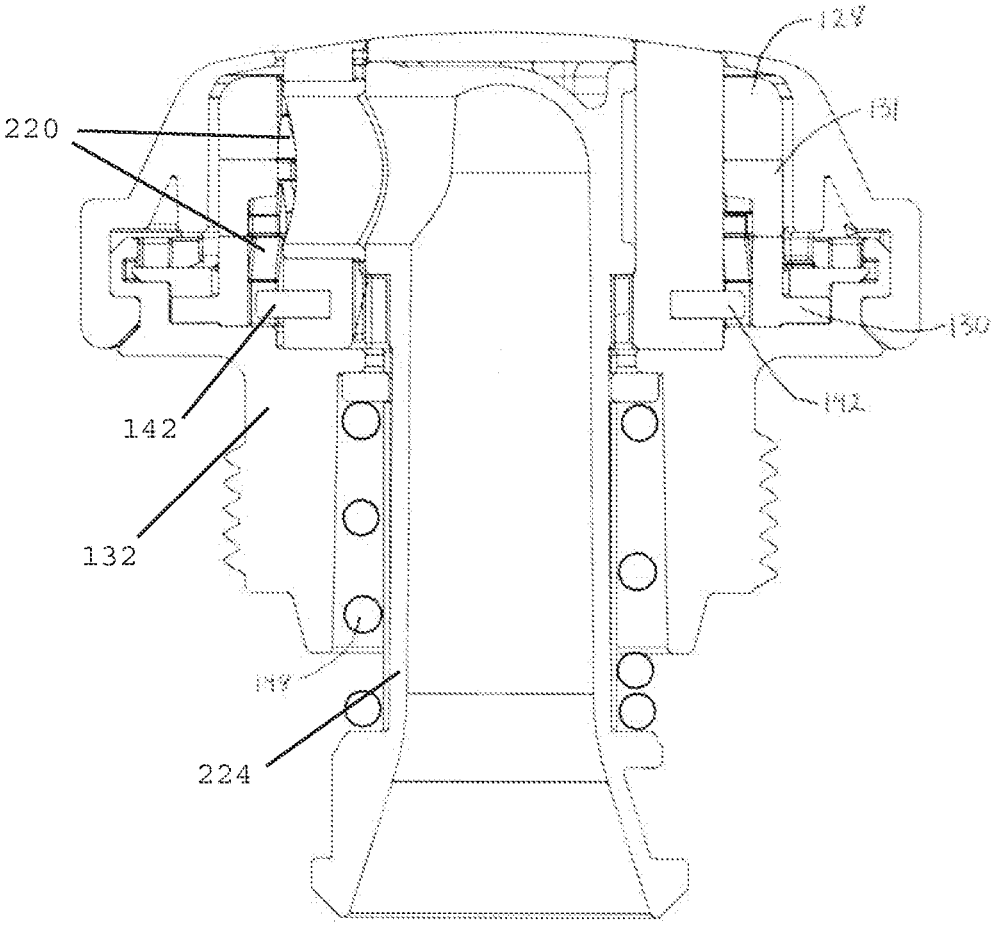
FIG. 10 is a cross-sectional view of an assembled nozzle assembly along sectional line A in FIG. 9.
Figure 15:
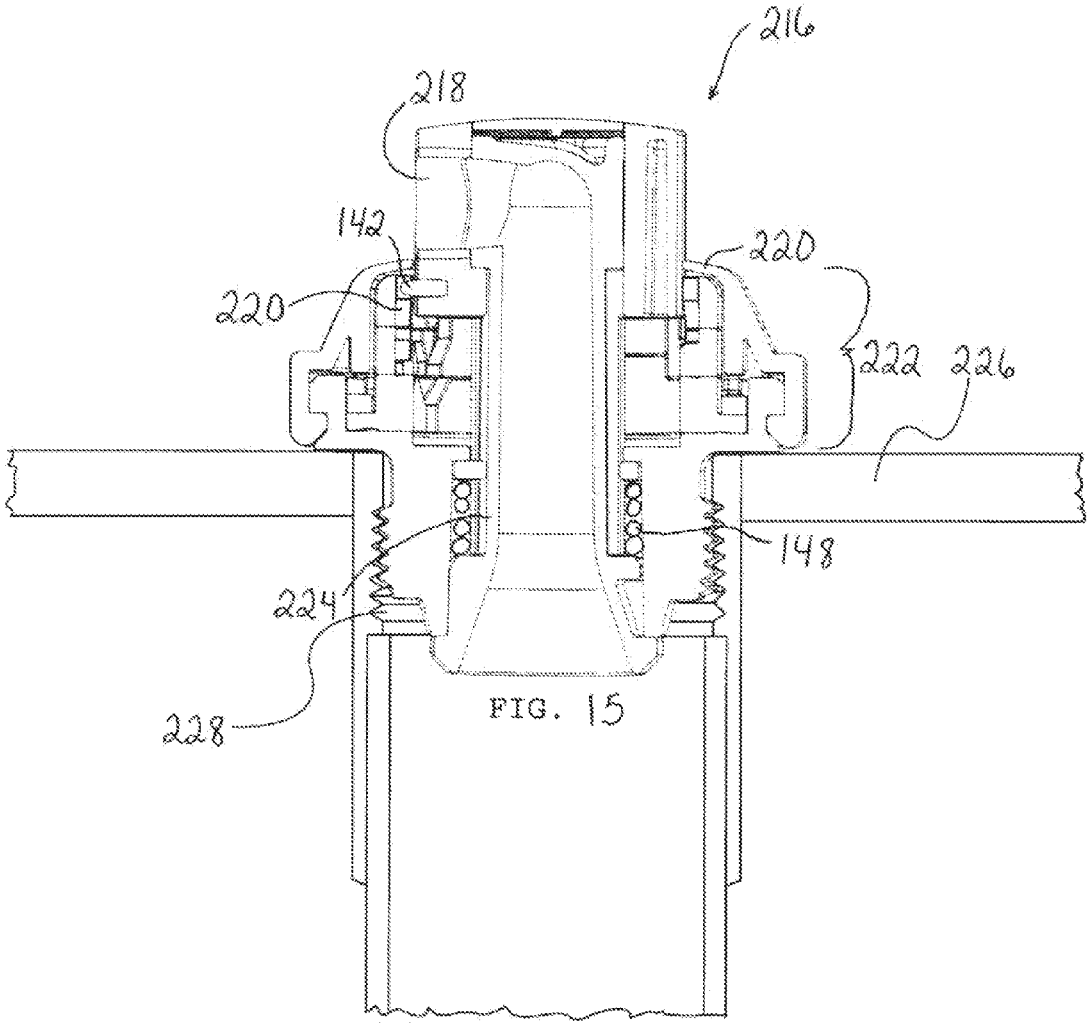
FIG. 15 is a cross-sectional view of an assembled nozzle assembly similar to that of FIG. 10, but in an extended position.

As illustrated in FIG. 9, implementations of a cleaning head assembly 124 may include a stem (sleeve) 140 that extends through the housing 132 and the cam assembly 126. In the particular implementation illustrated in FIG. 9, the stem 140 comprises at least one pin 142 that extends from a side of a head 150 (nozzle housing) that couples over the top of the stem 140. In other implementations, the at least one pin 142 may couple to other components associated with the stem 140 so that in either case (whether extending from the side of the head 150 or from some other component associated with the stem 140 or from the stem directly), the at least one pin 142 can be said to extend from the stem 140. In particular implementations of a stem 140, two or more pins 142 may be included, and the relation between the direction the pin 142 extends from the side of the stem 140 relative to the outlet 144 may range from about parallel to about perpendicular, depending upon system requirements. The pin 142 for these implementations engages with the cam assembly 124 within the upper section 128, the slidable section 131, and the lower section 130, as illustrated in FIG. 10. In particular implementations, the pin 142 may contact the edges of a plurality of saw teeth 146 within the cam assembly 126. The stem 140 may further include a spring element (coil spring) 148 (shown on FIG. 10) configured to provide bias force against the stem 140 when it is extended from the housing 132. FIG. 15 illustrates the cleaning head assembly 216 in an extended position, where the outlet 218 is raised above an upper surface of the cap ring 220 and the pin 142 is engaged against a surface of the saw teeth 220 in the upper section 6 of the cam assembly 222. In the extended position, the stem 224 is raised by water pressure force against the bias of the spring element 148. FIG. 15 also illustrates a swimming pool wall 226 with a threaded fitting 228 mounted in the wall. The cleaning head assembly 216 threadedly mates with the threaded fitting 228 in this implementation. Other coupling types are known four coupling a cleaning head assembly to a wall fitting and may equivalently be used in place of the threaded fitting shown here.

Figure 1:
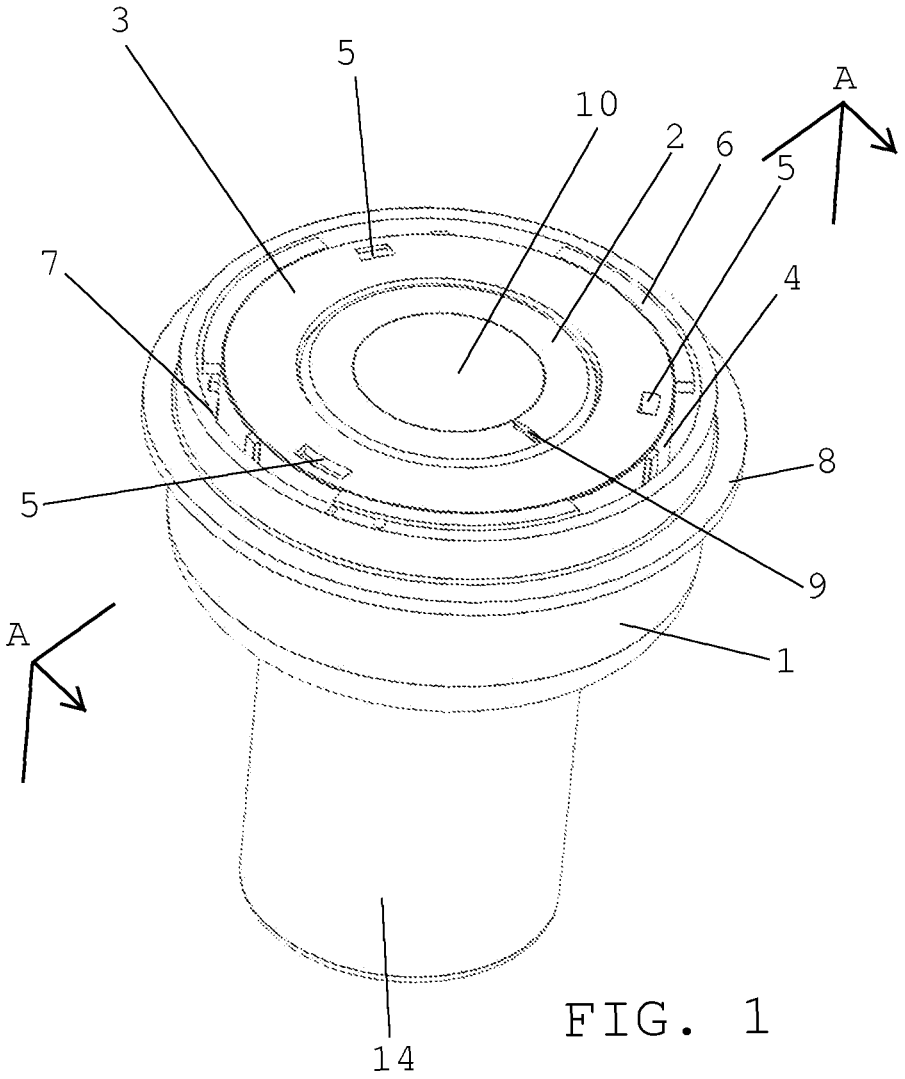
FIG. 1 is perspective view of a pool cleaning head assembly.
Figure 34:
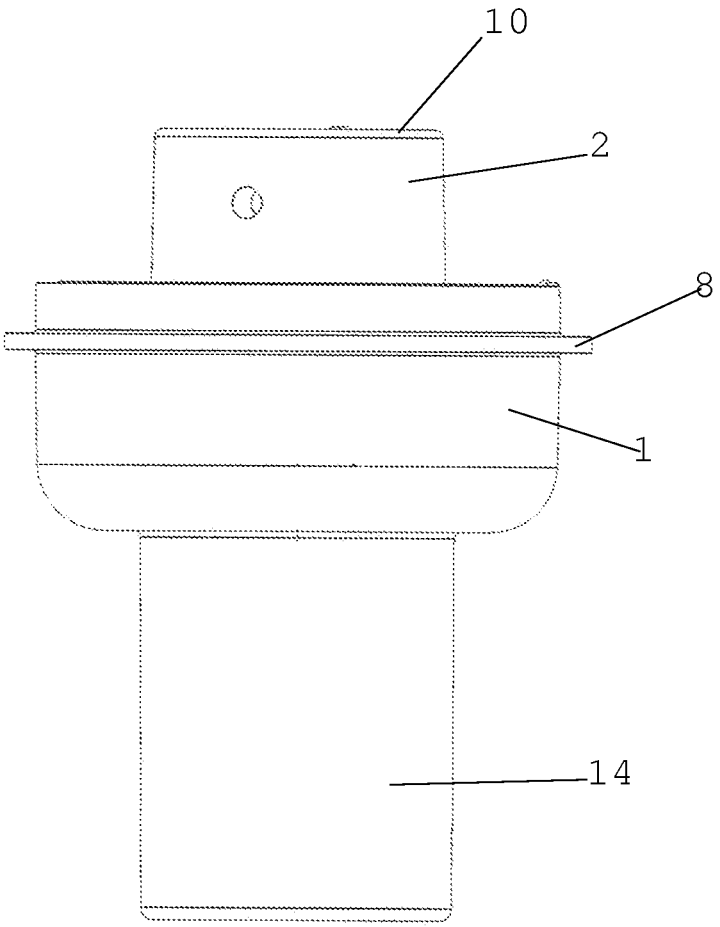
FIG. 34 is a side view of a pool cleaning head assembly in an extended position.

FIGS. 1-8 and 34 depict another embodiment of a cleaning head assembly. According to various aspects, the cleaning head assembly may comprise a variable rotating cleaning head assembly. In particular, FIG. 1 depicts a perspective view of a cleaning head assembly with the nozzle head 2 in a in a retracted position, and FIG. 34 depicts a side view of a cleaning head assembly with the nozzle head 2 in an extended, operating position. In the retracted position, the upper surface of the cleaning head assembly is substantially flush with the adjacent swimming pool surface 17 (see FIG. 2), or at least with a surface of a housing for the cleaning head assembly. In some embodiments, the cleaning head assembly comprises a body 1 comprising a hollow cylinder 14 for coupling to the interior of a plumbing pipe 57 (see FIG. 2) periodically supplying water under pressure to the cleaning head assembly. The body 1 typically further comprises a diametrically enlarged section coupled to the cylinder 14. A cap ring 3 may also be provided to finish flush with top of the body 1, a top of a retainer 4, a top of the nozzle head 2 when the nozzle head 2 is retracted, and/or the swimming pool surface 17.

In one or more embodiments, the cleaning head assembly comprises a nozzle removal flange 6 that is either coupled to or integral with the retainer 4 (also referred to as a housing or a cam housing). The nozzle removal flange is configured to provide coupling of a removal tool (not shown) in the typical manner. The cap ring 3 may further comprise one or more aiming tool ports 5 that are configured to receive a ring removal tool for operation of the cap ring 3. A nozzle removal tool recess 7 is also formed between the retainer 4 and the body 1 in one or more embodiments. The nozzle removal tool recesses are sized or otherwise configured to a receive nozzle removal tool in the conventional manner such that the retainer 4, stem 11, cam assembly 18 and nozzle head 2 are removable from the body embedded into the pool surface 17. Various embodiments of the nozzle head 2 further comprise a plate 10 coupled to the top of the nozzle head 2 and/or a nozzle direction indicator 9 that points the direction of water flow out of the nozzle head 2.

Figure 2:
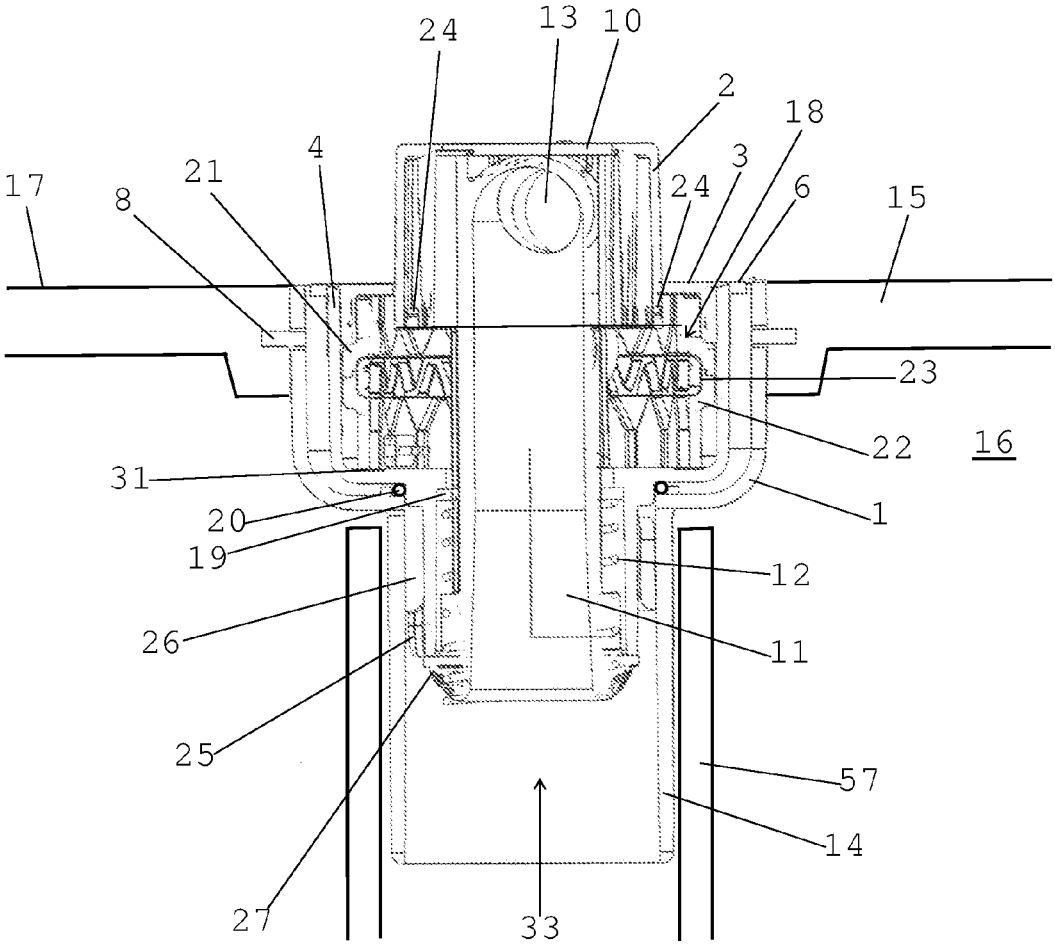
FIG. 2 is a cross-sectional view of the cleaning head assembly of FIG. 1 along line A-A with the pool cleaning head assembly being embedded in a pool surface.

With specific reference to FIG. 2, a cross-sectional view along lines A-A of the embodiment of FIG. 1 is depicted, with the nozzle head 2 in an extended position. The body 1 is configured to sealably fit in plumbing pipe 57 in the usual manner. More particularly, the cylinder 14 of the body 1 typically couples within or without the plumbing pipe 57 as is understood in the art. The body 1 is typically further configured to embed in a pool structure 16 and interior finish 15 in the conventional manner. However, while installation in a typical concrete pool is shown in FIG. 2, it is also contemplated that the body 1 could be and is adapted to be installed in any type of pool structure such as but not limited fiberglass, vinyl, steel and the like. As shown in FIG. 2, the retainer 4 typically finishes flush with interior pool surface 17 and the top of the body 1. Particular embodiments of the body 1 further comprise a plaster ring 8 that provides a water seal when the interior finish 15 is applied in the conventional manner. Furthermore, the stem 11 comprises a stop ledge 27 in one or more embodiments, the stop ledge 27 being configured to contact a lower end of the retainer 4 when the nozzle head 2 is in the raised position to limit upward movement of the stem 11 and seal a pressurized fluid flow 33 from escaping. This forces the substantially all of the fluid flow 33 through the nozzle orifice 13. The nozzle head 2 and the stem 11 are typically positionally coupled such that when one rotates, the other rotates simultaneously as the same rate and in the same direction.

The plate 10 of the nozzle head 2 is shown in FIG. 2 trapped between the top of the stem 11 and the nozzle head 2. In one or more embodiments, the cap ring 3 is removeably coupled to retainer 4 and indexed to a selected relational position. FIG. 2 also depicts a cross section view of a cam assembly 18, which shall be described in greater detail with relation to FIGS. 3-7. The cam assembly comprises an upper section 21, a lower section 22 and a slidable section 23 (also referred to as a reverser). The cap ring 3 guides the nozzle head 2 and locks the cam assembly 18 in a user-selected aimed position.

Particular embodiments of a cleaning head assembly comprise a nozzle removal flange 6 extending from the retainer 4. The nozzle removal flange 6 may be coupled to or integral with the retainer 4 and is configured to engage a nozzle removal tool in the conventional manner. The body may further comprise body installation lugs 26 in order to interface or engage with retainer installation lugs 25 for installation of the pool cleaning head assembly. Body installation lugs 26 and retainer installation lugs 25 may be indexably positioned in a desired location so the pool cleaning head assembly can be installed in only one rotatable position within the body 1, ensuring the previously set aim direction is preserved when the pool cleaning head assembly is removed and replaced for service or inspection.

One or more embodiments of a cleaning head assembly further comprise a thrust washer 19 that is slideably engaged with stem 11 and the retainer 4. The thrust washer resists wind-up of spring 12 and reduces friction between the spring 12 and the retainer 4. At least one but typically two cam pins 24 are disposed in or about the nozzle head 2 to engage the cam assembly 18. The spring 12 serves to bias the stem 11 and nozzle head 2 downwardly to a retracted position in the absence of the pressurized flow 33. In this way, the one or more pins 24 will engage the cam assembly 18 to rotate the nozzle head 2 and the stem 11 upon each pressurization and depressurization of pressurized fluid flow 33. A ring seal 20 serves to seal pressurized fluid flow 33 and add tension in the interface of body installation lugs 26 and retainer installation lugs 25.

In one or more embodiments of a cleaning head assembly, the lower section 22 of the cam assembly 18 comprises a serrated bottom 31. The serrated bottom 31 of the lower section 22 is typically configured to engage with a serrated portion of the retainer 4. Engagement between the serrated bottom 31 and the retainer 4 helps prevent undesired rotation of the cam assembly 18.

Figure 3:
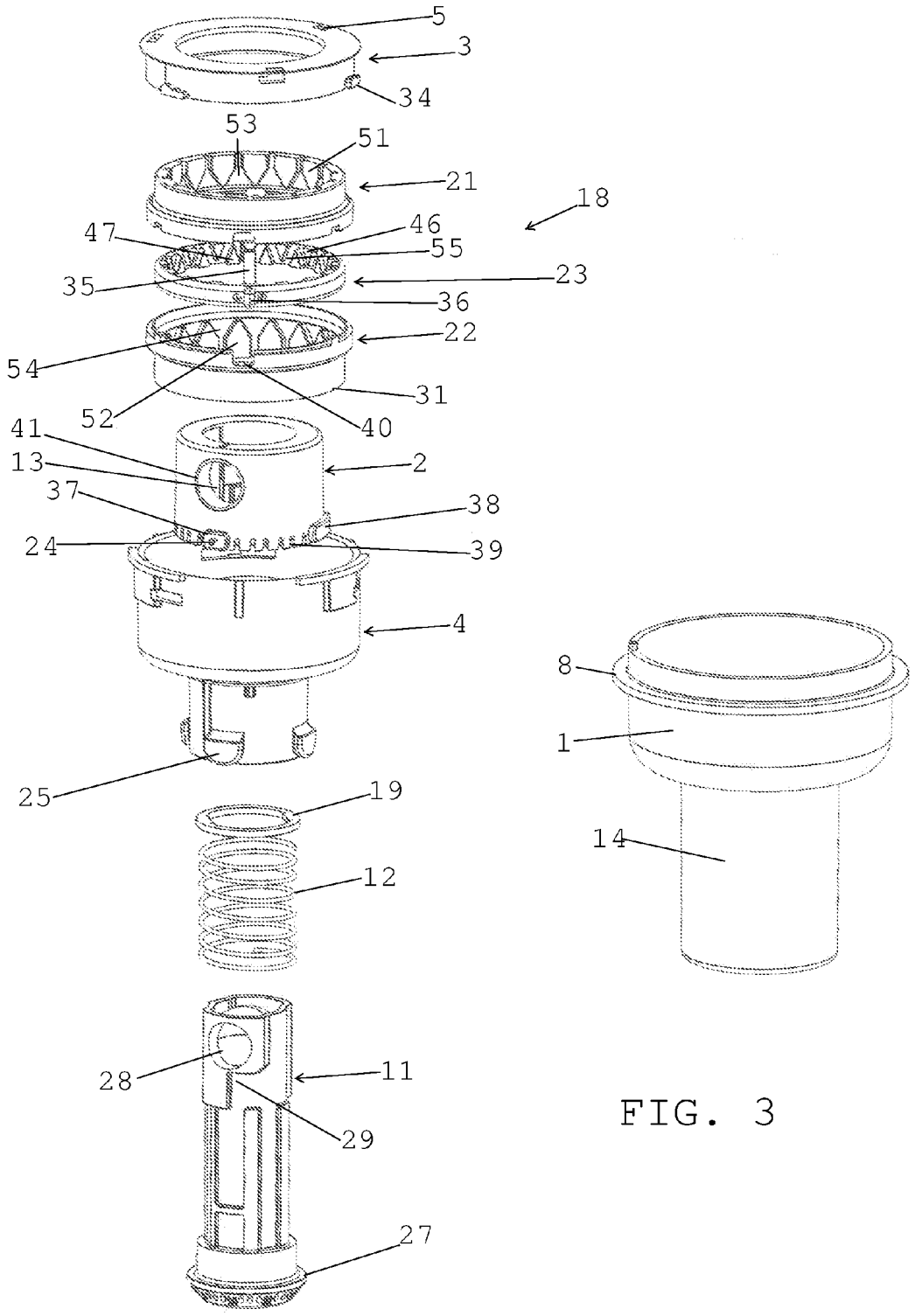
FIG. 3 is an exploded perspective view of a pool cleaning head assembly.

With particular reference to FIG. 3, an exploded perspective view of a cleaning head assembly is provided. As depicted, the cam ring 3 comprises one or more aim lugs extending therefrom and one or more aiming tool ports 5. The stem 11 may comprise any nozzle locking lug 29 as depicted or otherwise previously known in the art. The stem 11 typically further comprises a stem outlet 28 that aligns with the nozzle orifice 13 the stem is positionally coupled to the nozzle head 2, allowing water to flow through the stem 11, the stem outlet 28, and the nozzle orifice 13.

The cam assembly 18 depicted in FIG. 3 comprises an upper section 21 (also referred to as an upper cam), a lower section 22 (also referred as a lower cam), and a slidable section 23 (also referred to as a reverser). In one or more embodiments, the upper section 21 comprises a plurality of saw tooth members 51 that typically narrow downward. A pin guide 53 separates adjacent saw tooth members 51. Each pin guide 53 typically narrows upward. The saw tooth members 51 and pin guides 53 typically surround an inner portion of the upper section 21.

In one or more embodiments, the lower section 21 likewise also comprises a plurality of saw tooth members 52 that typically narrow upward. A pin guide 54 separates adjacent saw tooth members 52. Each pin guide 54 typically narrows downward. The saw tooth members 52 and pin guides 54 typically surround an inner portion of the lower section 22.

In one or more embodiments, the slidable section 23 comprises a plurality of saw tooth members 46, 47. In particular, saw tooth members of the slidable section 23 may comprise alternating upper saw tooth members 46 that narrow downward and lower saw tooth members 47 that narrow upward. The alternating saw tooth members 46, 47 of the slidable section 23 are each separated by a pin guide 55. The saw tooth members and pin guides 55 typically surround an inner portion of the slidable section 23.

Particular embodiments of the slidable section 23 further comprise a reverser arm 35 and reverser stop lug 36. The reverser arm 35 is shaped or otherwise configured to engage with a first or primary reversing tab 37 and a second or secondary reversing tab 38. The reverser arm may either removably coupled, fixedly coupled, or integral with the slidable section 23. More particularly, the reverser arm 35 may extend either upward or downward from the slidable section 23. In a particular embodiment, reverser arm 35 extends from an inner portion of the slidable section 23, and the reverser stop lug 36 extends from an outer portion of the slidable section 23.

In alternative embodiments, only a primary reversing tab 37 is required. For example, the primary reversing tab 37 may be configured such that opposing ends of the primary reversing tab 37 contacts the reverser arm 35 at different times to shift the slidable section 23 from the first extent to the second extent. More particularly, a primary end of the primary reversing tab 37 may contact the reverser 35 to shift the slidable section 23 from the first extent to the second extent. Upon changing directions, a second side of the primary reversing tab 37 will contact the reverser 35 and shift the slidable section 23 from the second extent to the first extent. In such embodiments, the primary reversing tab 37 may be elongated to a length that will produce the desired cleaning arc. More particularly, the primary reversing tab 37 may be adjustable in length to accommodate the desired cleaning arc.

In one or more embodiments, the upper section 21 and the lower section 22 are configured to coupled together with the slidable section 23 at least partially positioned between the upper section 21 and the lower section 22. The upper section 21 and lower section 22 may comprise one or more tab and/or tab receivers that are aligned with one another such that the upper section 21 and lower section 22 are positionally coupled to one another (see FIG. 8). According to one aspect, each of the upper section 21 and the lower section 22 comprise a reverser stop recess 40. When the upper section 21 and the lower section 22 are coupled together, the reverser stop recesses 40 are aligned to form an opening extending through the coupled upper section 21 and lower section 22.

Figure 8:
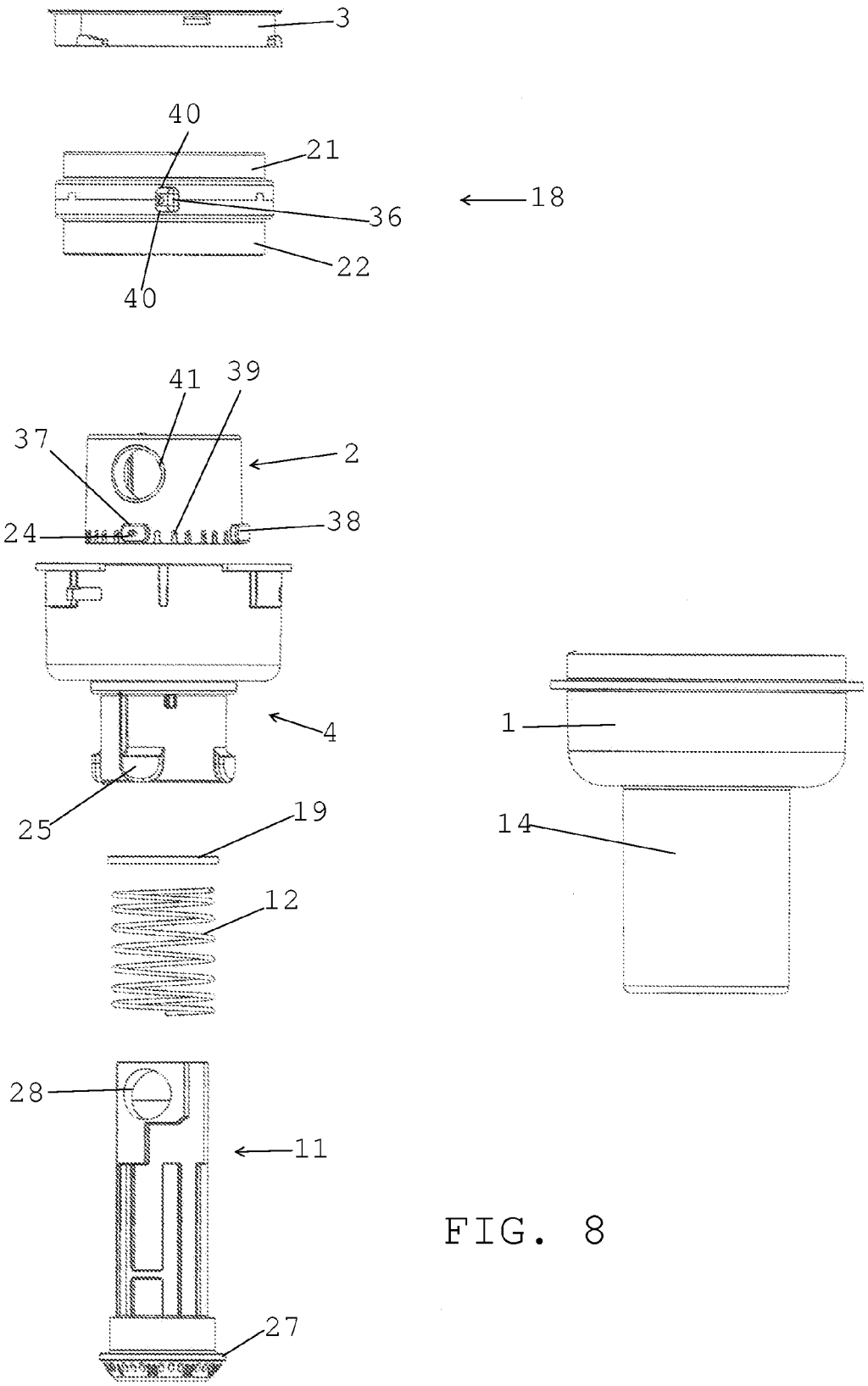
FIG. 8 depicts an exploded side view of a pool cleaning head assembly.

The slidable section 23 is configured to position within and/or between the upper section 21 and the lower section 22 in one or more embodiments when the upper section 21 and the lower section 22 are coupled together. When positioned between the coupled upper section 21 and lower section 22, the slidable section 23 is slidable or rotatable between a first extent and a second extent. Particular embodiments of the slidable section 23 comprise a reverser stop lug 36. The reverser stop lug 36 extends through the aligned reverser stop recesses 40, which act as limits to the rotational travel of the reverser arm 35 and consequently reverser 23. Specifically, the aligned reverser stop recesses 40 engage the reverser stop lug 36 to limit extent of rotation. FIG. 8 depicts the upper section 21 coupled to the lower section 22, with the reverser stop lug 36 extending through the aligned reverser stop recesses 40.

As referenced above, one or more embodiments of the nozzle head 2 comprise a primary reversing tab 37 and a secondary reversing tab 38 coupled thereto. The primary reversing tab 37 may be either fixedly or permanently coupled to the nozzle head 2 or, alternatively removably coupled to the nozzle head 2. A pin 24 typically extends from or through the primary reversing tab 37. In particular embodiments, the pin 24 anchors the reversing tab 37, 38 to the nozzle head 2. The secondary reversing tab 38 may either be fixedly or removably coupled to the nozzle head 2 and may likewise comprising a pin 24 extending therefrom or therethrough. The secondary reversing tab 38 is typically removably coupled to the nozzle head 2 and its positioning determines the extent or degrees of the cleaning arc of nozzle head 2. In one or more embodiments, the nozzle head 2 comprises tab slots 39 that engage pins on the reversing tabs 37 and/or 38 to change extent or direction of rotation. More particularly, the either the primary reversing tab 37 or the secondary reversing tab 38 may removably couple to the nozzle head 2 through engagement with one or more of the tab slots 39. Although not shown in FIG. 3, the primary reversing tab 37 and/or the secondary reversing tab 38 may comprise one or more inwardly extending pins or tabs that removably couple within the tab slots 39.

In one or more embodiments, a thrust washer 19 and a washer spring 12 slip over the stem 11. Lugs on a thrust washer 19 may engage a recess on the stem 11 in the conventional manner, slip into the lower portion of the retainer 4, and lock into the nozzle head 2 in the conventional manner. A removable nozzle insert 41 may be used to modify the nozzle diameter in the conventional manner.

With specific reference to FIGS. 4-7, a diagrammatic view of the cam assembly 18 of FIG. 3 is depicted to show operation of nozzle head 2 rotation and direction reversal in detail. It is understood that pins 24 extend outwardly and radialy from the nozzle head 2 enough to interface and react with the saw tooth members 46, 47, 51, 52 and move through pin guides 53, 54, 55. In the particular embodiment diagrammed, the reverser arm 35 is coupled to an upper saw tooth member 46 of the slidable section. Thus, the reverser arm 35 is position to react or engage with the primary reversing tab 37 and the second reversing tab 38. In a particular embodiment, the reverser arm 35 is shaped and sized to move the slidable section 23 only when the one or more pins 24 is not interacting with the saw tooth members 46, 47 or pin guides 55 of the slider section.

As previously referenced, the primary reversing tab 37 is either fixedly or removably coupled to the nozzled head 2. Positioning of the primary reverser tab 37 defines a first extent of rotation of the slidable section 23 and thus rotation of the nozzle head 2. Positioning of the secondary reversing tab 38 defines a second extent of rotation of the slidable section 23 and thus rotation of the nozzle head 2. The reverser arm 35 interacts with the primary reversing tab 37 and the secondary reversing tab 38 to move the slidable section 23 and ultimately change the direction of rotation of the nozzle head 2.

Figure 4:
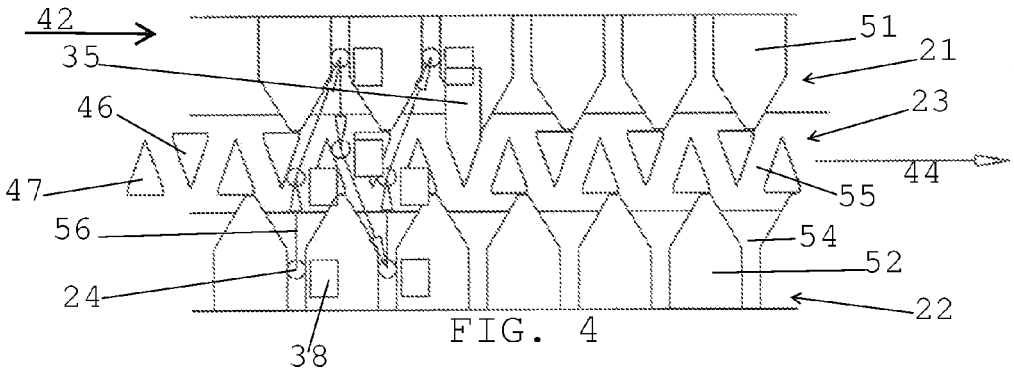
FIG. 4 diagrams a first travel path of a pin through a cam assembly of a pool cleaning head assembly.

FIG. 4 diagrams rotation of a nozzle head 2 in a first direction 42 as the pin 24 and the secondary reversing tab 38 approaches the reverser arm 35. As diagrammed, the pin 24 follows pin path 56, drawing the secondary reversing tab 38 closer to the reverser arm. Intermittent water pressure 33 through the stem 11 raises and rotates the nozzle head 2. As the pin 24 follows the pin path 56 upwards, the pin 24 interacts with an upper saw tooth member 46 that slightly rotates the nozzle head 2 by redirecting the path of the pin 24. Similarly, when water pressure through the stem 11 has ended, the springs 12 bias the stem 11 and nozzle head downward to a retracted position. As the nozzle head 2 retracts, the pin 24 interacts with a lower saw tooth member 47 that slightly rotates the nozzle head 2 by redirecting the path of the pin 24. This process is repeated until the secondary reversing tab 38 contacts the reverser arm 35. When the secondary reversing tab 38 contacts the reverser arm 35, the slidable section 23 is shifted in the same direction 44 as rotation of the nozzle head 2 in the first direction 42, thus sliding the slidable section 23 from the first extent to the second extent.

Figure 5:
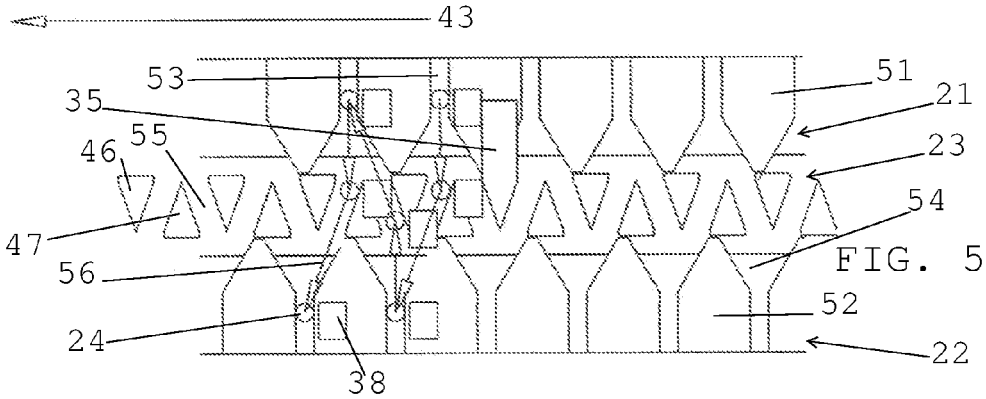
FIG. 5 diagrams a second travel path of a pin through a cam assembly of the cleaning head assembly.

FIG. 5 diagrams the slidable section 23 after having slid to from the first extent to the second extent. Rotation of the slidable section 23 alters the pin path 56 such that rotation of the nozzle head 2 is reversed from the first direction 42 to a second direction 43. Similar to the description presented in relation to FIG. 4, intermittent water pressure through the stem 11 results in the pin 24 following guide 56, only now the pin 24 travels in an opposite direction due to the shift of the slidable section 23 from the first extent to the second extent. As the pin 24 follows pin path 56, the nozzle head 2 rotates in the second direction 43. In FIG. 5, neither the primary reversing tab 37 nor the secondary reversing tab 38 contacts the reverser arm 35, and thus the slidable section 23 does not shift. Rotation of the nozzle head 2 continues in the second direction 43 until the slidable section 23 is again shifted.

Figure 6:
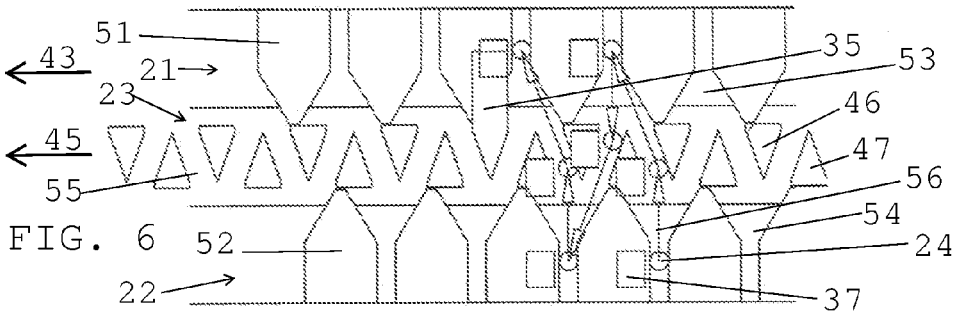
FIG. 6 diagrams a third travel path of a pin through a cam assembly of a cleaning pool cleaning head assembly.

FIG. 6 diagrams rotation of a nozzle head 2 in the second direction 43 as the pin 24 and the primary reversing tab 37 approaches the reverser arm 35. As diagrammed, the pin 24 follows pin path 56, drawing the primary reversing tab 37 closer to the reverser arm 35. Intermittent water pressure 33 through the stem 11 raises and rotates the nozzle head 2. As the pin 24 follows the pin path 56 upwards, the pin 24 interacts with an upper saw tooth member 46 that slightly rotates the nozzle head 2 by redirecting the path of the pin 24. Similarly, when water pressure through the stem 11 has ended, the springs 12 bias the stem 11 and nozzle head downward to a retracted position. As the nozzle head 2 retracts, the pin 24 interacts with a lower saw tooth member 47 that slightly rotates the nozzle head 2 by redirecting the path of the pin 24. This process is repeated until the primary reversing tab 37 contacts the reverser arm 35. When the primary reversing tab 37 contacts the reverser arm 35, the slidable section 23 is shifted in the same direction 45 as rotation of the nozzle head 2 in the second direction 43, thus sliding the slidable section 23 from the second extent to the first extent.

Figure 7:
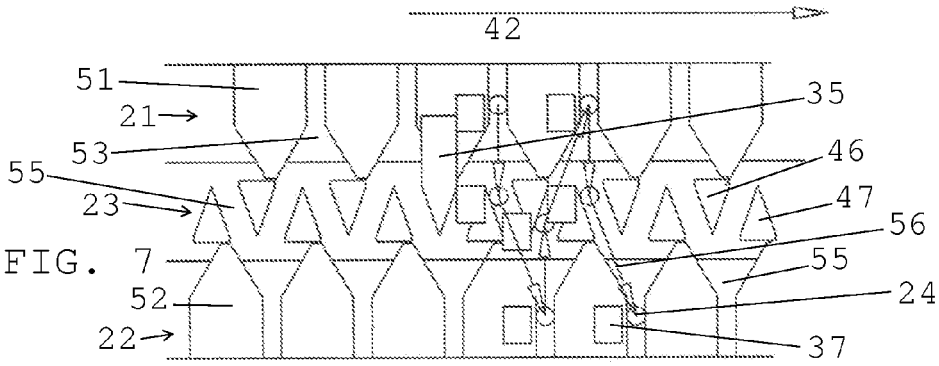
FIG. 7 diagrams a fourth travel path of a pin through a cam assembly of a pool cleaning head assembly.

FIG. 7 diagrams the slidable section 23 after having slid to from the second extent to the first extent. As previously described, rotation of the slidable section 23 alters the pin path 56 such that rotation of the nozzle head 2 is reversed from the second direction 43 back to the first direction 42. Similar to the description presented above, intermittent water pressure through the stem 11 results in the pin 24 following guide 56, only now the pin 24 travels in an opposite direction due to the shift of the slidable section 23 from the first extent to the second extent. As the pin 24 follows pin path 56, the nozzle head 2 rotates in the second direction 42. In FIG. 7, neither the primary reversing tab 37 nor the secondary reversing tab 38 contacts the reverser arm 35, and thus the slidable section 23 does not shift. Rotation of the nozzle head 2 continues in the first direction 42 until the slidable section 23 is again shifted.

As has been demonstrated by the diagrams of FIGS. 4-7, embodiments of the pool cleaning head assembly described herein establish a cleaning arc for the cleaning head assembly. That is, the nozzle orifice 13 of the nozzle head rotates a certain value of degrees between shifting of the slidable section 23 from the first extend to the second extent. As briefly referenced above, positioning of the primary reversing tab 37 and secondary reversing tab 38 determine when the slidable section is shifted, and thus determine the degree of the cleaning arc of the cleaning head assembly. In embodiments wherein at least one of the primary reversing tab 37 and the secondary reversing tab 38 are removably coupled to the nozzle head 2, the degree of the cleaning arc is adjustable by movement of either of the reversing tabs 37, 38 to a desired position. In a particular embodiment, the cleaning arc is adjustable between approximately 23 and 360 degrees.

As shall be described in greater detail below, embodiments of the pool cleaning head assembly disclosed herein are advantageous to those previously known in the because proper positioning of the pool head assembly ensures that debris is constantly being moved toward the drain of the pool. Providing a pool cleaning head assembly comprising an adjustable cleaning arc provides additional advantages to previous cleaning head assemblies because a user is now able to adapt the pool cleaning head assembly for the particularities of individual pools.

In one or more embodiments, an aiming tool is used to direct the cleaning pattern. The aiming tool may be configured to pick up on a keying feature in the body 1 embedded in the pool surface 17. In a particular embodiment, the aiming tool comprises a visual arc that is adjustable to the pre-determined or desired cleaning arc for that particular cleaning head assembly location. The arc may then be adjusted and the tool is inserted into the key body. The tool may then be rotated until the arc is at the desired orientation, and the tool is removed from the body 1. In particular embodiments, an indicator on the tool lines up with a number. This number corresponds with a number on the tool used to lock the nozzle cover down. The nozzle cover may be loosened and the cleaning head assembly may be turned until an indicator on the top of the cleaning head assembly lines up with the number from the aiming tool. This puts the cleaning head assembly at the beginning side of the cleaning arc. The cleaning head assembly may then be installed into the body 1 in the pool.

In one or more embodiments, the direction of the cleaning arc may be adjusted after the cleaning head assembly is installed but prior to filling the pool with water. In this particular embodiment of FIGS. 4-7, a pin is inserted in the back of the cleaning head assembly to keep the cleaning head assembly in the extended position. The nozzle cover may then be Weloosened so the cleaning head assembly may be turned until the nozzle orifice 13 is pointed in the direction of the beginning of the cleaning arc. The pin may then be removed, thus allowing the cleaning head assembly to retract into the body 1.

Referring to FIG. 15, an illustration of the interior of a cam assembly (example as cam assembly 126 in FIG. 9) for a cleaning head assembly (example as cleaning head assembly 124 in FIG. 9) is shown with reference to the particular implementation of FIG. 9 as an example. As illustrated, the edges of the saw teeth 152, 154, 156, or other guides 152, 154, 156, of the upper section 128 and slidable section 131 of the cam assembly 126 form a plurality of channels 158, 160, 162 in which a pin 142 travels during operation of a cleaning head assembly 124. For ease of understanding, slidable section 131 has been marked in FIGS. 11 and 12 with right downwardly sloping hatch marks. The pin 142 has been marked with right upwardly sloping hatch marks. Although the FIGS. Show more than one pin 142, this is intended to be illustrative of the movement of the pin 142 from one end of a channel to another end and not necessarily that there are two pins 142 in the particular implementation.

During operation of the cleaning head assembly, water pressure force is intermittently exerted on the stem 140, forcing it to extend upwardly. As the stem 140 moves upwardly, the pin 142 also travels upwardly in a first channel 158 formed to a side of the edges of the saw teeth 152, 154. It should be understood that in its ordinary rest position, the pin 142 would not be in the upper position (as 142*a*) between tooth 152 of the upper cam 128 and the shifter 129, but would be resting within the lower cam section 130. When the water pressure force is removed, the bias of the spring element 148 withdraws the stem 140 into the housing 132 (see FIG. 9). As the stem 140 withdraws, the pin 142 travels downwardly through the first channel 158 (as indicated by the arrow 164). In the process, the rotational position of the stem 140 may travel incrementally clockwise (or counterclockwise depending upon the direction of movement for the stem). When the intermittent water pressure force is once again exerted on the stem 140, the pin 142 travels upwardly between the saw teeth 154, 156 into the second channel 160, as indicated by the arrow 168. Once again, the rotational position of the stem 140 may continue to move incrementally clockwise (or counterclockwise) until it rests in the position illustrated in FIG. 12 as pin 142*d*. It should be noted that when the pin 142*d* initially comes to rest in the position illustrated in FIG. 12, the slidable section 131 (and integral shifter 129) is still in its position to the left illustrated in FIG. 12.

Figure 12:
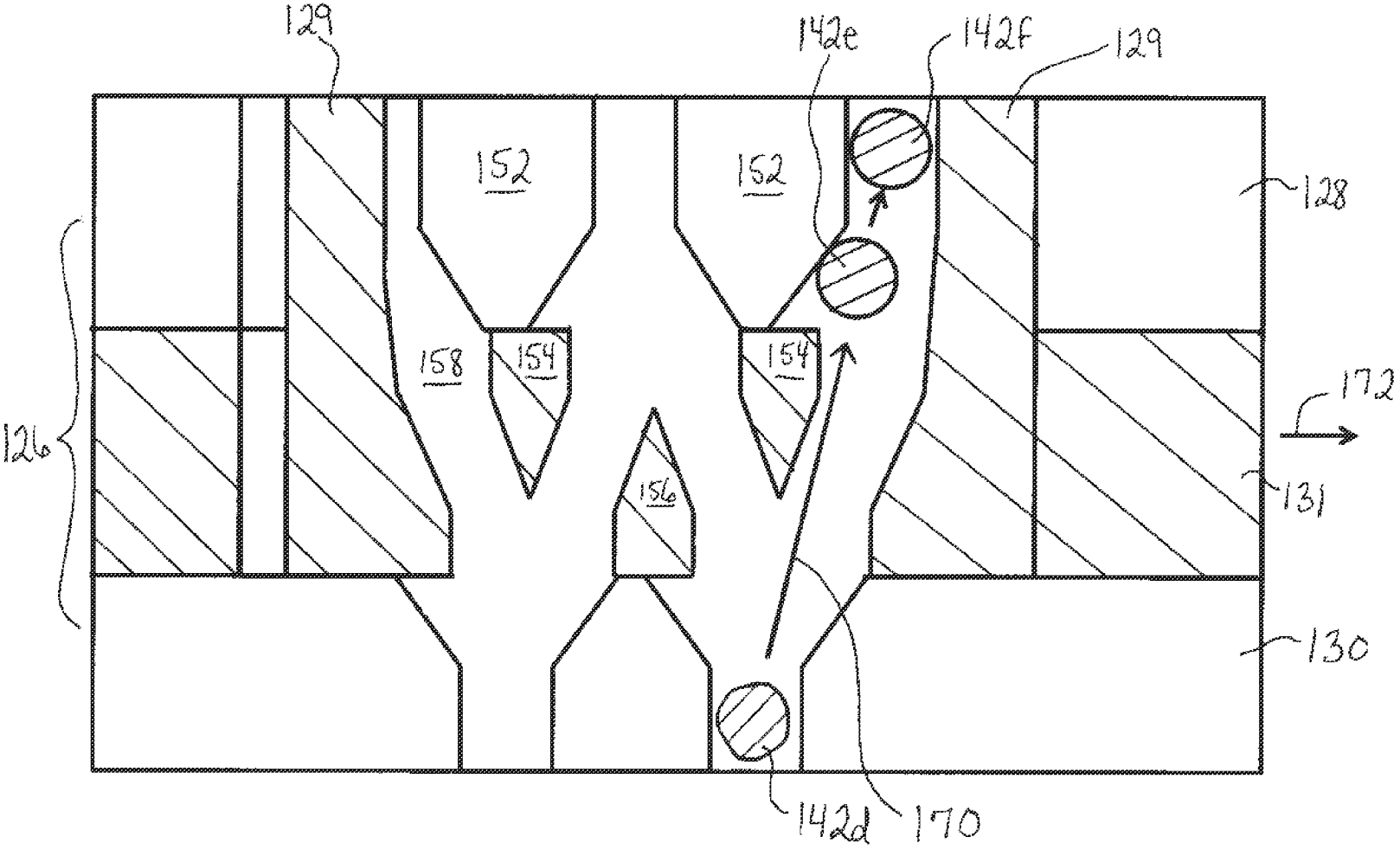
FIG. 12 illustrates the travel path of a pin through the cam of an implementation of a nozzle assembly indicating the movement of the slidable section of the cam followed by intermittent rotation counterclockwise.
Figure 13:
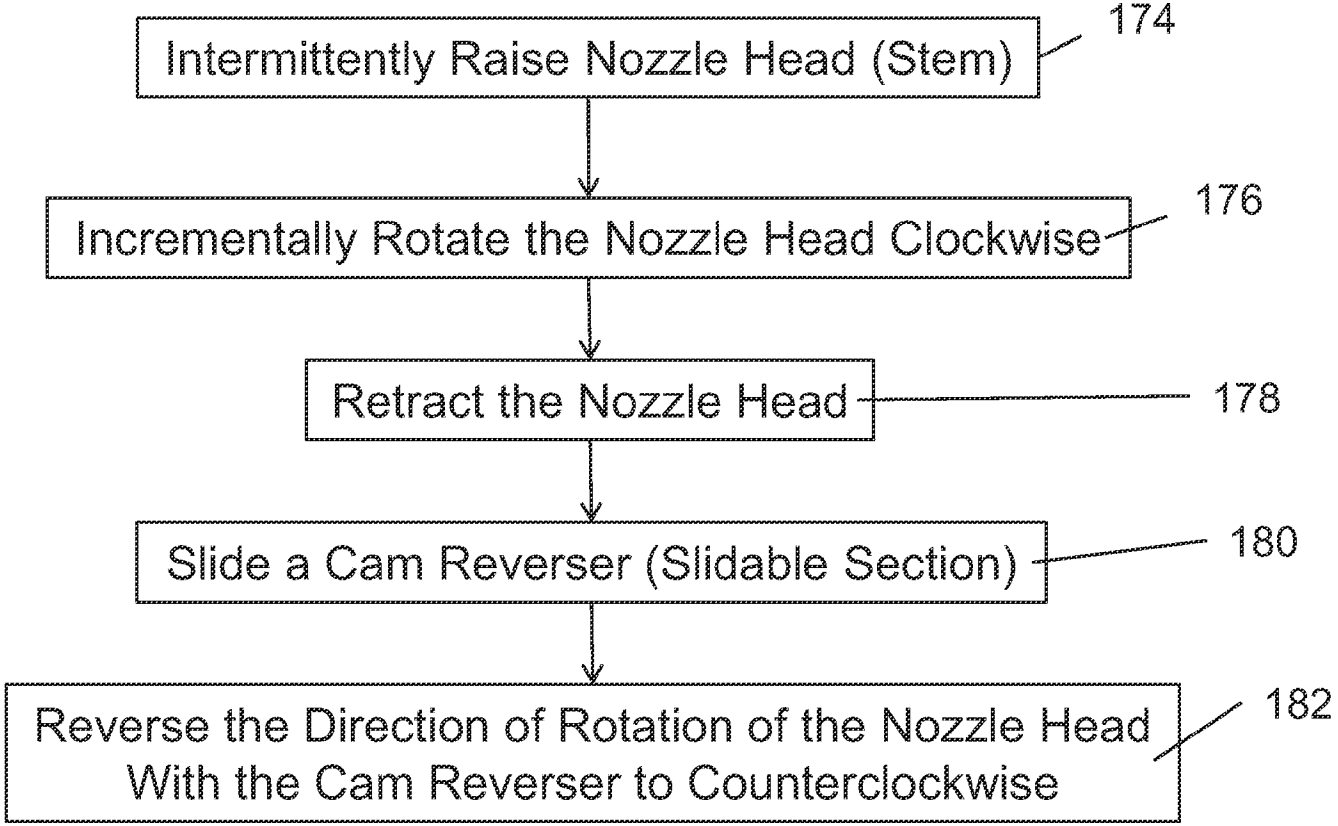
FIG. 13 is a flow diagram of the steps of a method of cleaning a swimming pool utilized by particular implementations of swimming pool cleaning heads.

Referring to FIG. 12, as the water pressure force is again removed from the stem 140, the bias of the spring element 148 draws the stem 140 (see FIG. 9) downward again, causing the pin 142 to travel between saw teeth 156, 154, further moving the rotational position of the stem 140 incrementally clockwise (or counterclockwise). By repeating the intermittent application and removal of water pressure force, stem 140 rotate until the pin 142 enters the third channel 162, as indicated by arrow 170 (FIG. 12 in a first slidable section position and FIG. 13 illustrating a second slidable section position) for as many channels the cam assembly includes until it reaches the limits of the cam rotation. For the implementation shown in FIGS. 12 and 13, the implementation includes only four channels 158, 230, 160 and 162.

After the pin 142*d* is positioned at the start of the final channel 162, with the shifter 129 in its position illustrated in FIG. 12, water pressure force is exerted on the stem 140 and the pin 142 enters the final channel 162 as indicated by the arrows. When the pin 142 reaches its position as pin 142*e* in FIG. 12, the interference of the pin 142*e* with the shifter 129 to its right pushes the shifter 129 (and integral slidable section 131) to the right so that the pin 142 can move to its end position as pin 142*f*.

Figure 11:
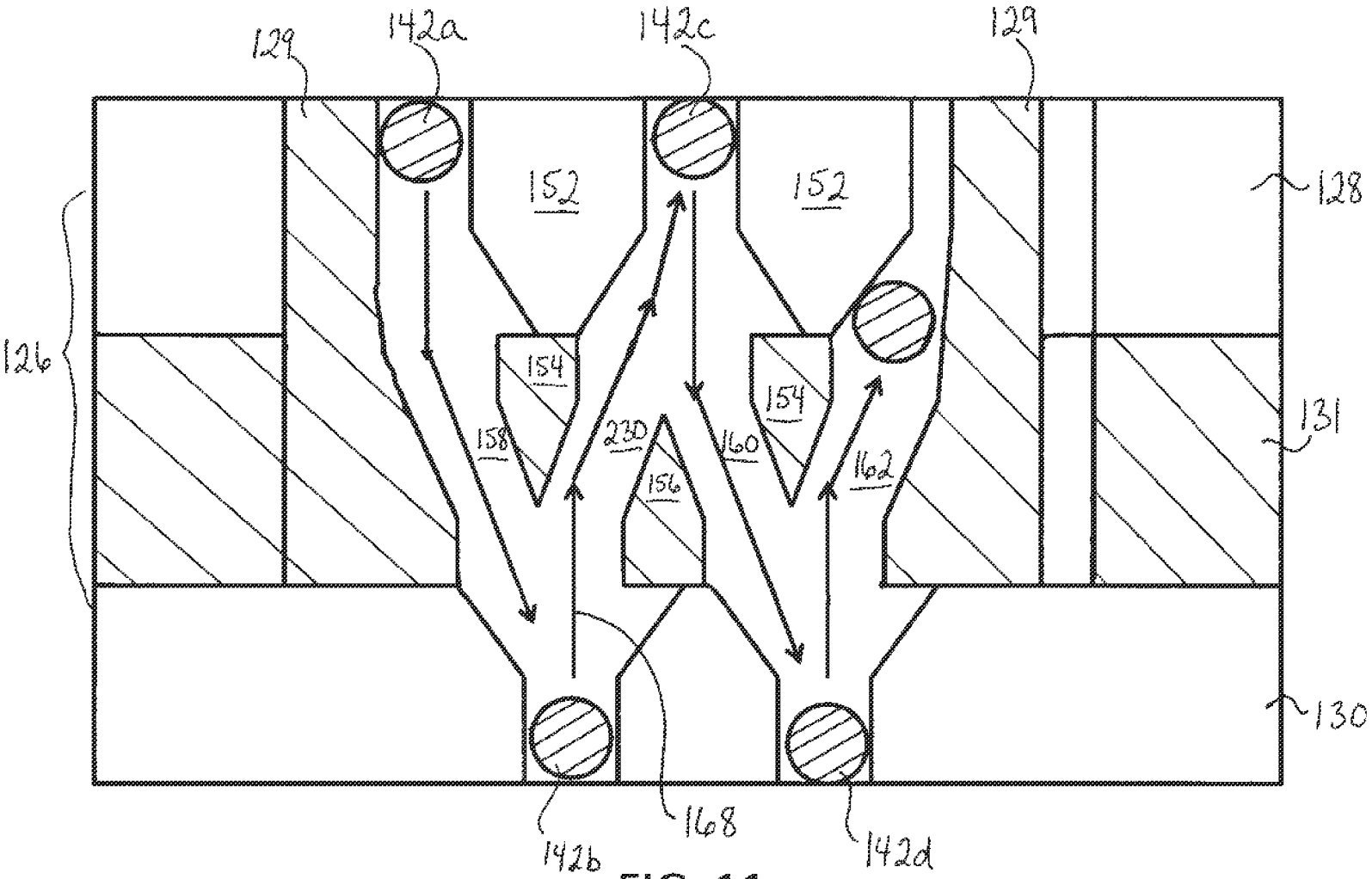
FIG. 11 illustrates the travel path of a pin through the cam of an implementation of a nozzle assembly during intermittent rotation clockwise.

The top of channel 162 is originally narrower than the diameter of the pin 142 (see FIG. 11 for its earlier position). As the pin 142 enters channel 162 under water pressure force as indicated by arrow 170, the pin 142 presses against the edge of saw tooth 152 and against shifter 129, moving the shifter 129 and inducing slidable rotation of the slidable section 131 in relation to the upper and lower cam sections 128 and 130, and a widening of channel 162 to allow the pin 142 to fully enter channel 162. Arrow 172 in FIG. 12 shows the direction of rotation of the slidable section 131 in relation to the remainder of the cam assembly 126. As channel 162 widens through rotational movement of the shifter 129 coupled to the slidable section 131 of the cam assembly, the width of channel 158 is reduced (see FIG. 12 as compared with FIG. 11). When the pin 142 reaches channel 162 and completes widening it, the cleaning head assembly 124 (FIG. 9) has reached a first limit position or a predetermined limit after completing a predetermined number of rotational steps and is no longer able to rotate further in the clockwise direction.

When the water pressure force is removed from the stem 140, the pin 142 travels back down channel 162. As the pin 142 does so, the angular position of the stem 140 begins to be incrementally and/or automatically adjusted in the counterclockwise direction just like it was previously in the clockwise direction. Under the influence of the intermittent water pressure force, and through the action of the engagement of the pin 142 within the cam assembly 126, the angular position of the stem 140 continues to incrementally travel in the counterclockwise direction until the pin 142 slidably rotates the slidable section 131 back by entering and widening channel 158, or through reaching a second limit position or predetermined limit. Through automatic positioning and reversal of the pin movement within the predetermined limits of the cam assembly, the cleaning head assembly automatically begins another cycle of movement in the clockwise direction after completion of a predetermined number of rotational steps. The ability of the slidable section 131 to slidably rotate with respect to the lower and upper sections 130, 128 enables the automatic reversal of the direction of rotation of particular implementations of cleaning head assemblies 124.

While the implementation of a cam assembly 126 illustrated in FIGS. 11 and 12 comprise only a few saw teeth 152, 154, 156, and three channels 158, 160 and 162, in other particular implementations, any number of saw teeth and corresponding channels may be employed. Such implementations may, therefore, incorporate smaller or larger rotational increments (steps), be evenly spaced or unevenly spaced, and/or incorporate a wider or shorter range of rotational movement before automatically reversing direction. For example, the saw teeth 152, 154, 156 may be spaced any distance apart to increase or decrease the stepwise rotational distance the stem 140 turns as water pressure force is intermittently applied. In addition, the degree of rotation of the stem 140 allowed by the number of saw teeth 152, 154, 156 employed may range in particular implementations from substantially 360 degrees to substantially 0 degrees, depending upon the desired location and function of the cleaning head assembly 124. The rotation range to which particular implementations may be designed is limited only by the space needed for the left and right edges of the shifter 129 and the stops provided on the left and right of the upper and/or lower cam sections 128, 130. It will be understood, however, that the actual dimensions of the stops and edges may vary greatly by the particular materials used to create the cam assembly 216 and the pressures to which the cam assembly is exposed. It is anticipated, however, that in most cases the rotation range needed will be sufficiently below 360 degrees and sufficiently above 0 degrees that the stops and shifter edges widths will not be a concern.

Also, in particular implementations, the relative sizes of the saw teeth 152, 154, 156 and/or angles of the channels 158, 160, 162 may be varied to allow the stem 140 to rotate a greater angular distance during certain rotational cycles than in others. Implementations employing regularly sized and spaced saw teeth 152, 154, 156 may employ a method of cleaning a pool floor that includes rotating the position of the stem 140 a certain predetermined distance within a predetermined or irregular interval of time. In implementations employing irregularly sized and/or spaced saw teeth 152, 154, 156, the method may employ rotating the position of the stem 140 according to a predefined pattern during a predetermined or irregular interval of time.

Referring to FIG. 13, a flowchart of method steps is illustrated. Implementations of a pool cleaning head may include a method of use that may include the steps of intermittently raising the nozzle head (stem, step 174), incrementally rotating the nozzle head clockwise (step 176), and retracting the nozzle head (step 178). In particular implementations, steps 174, 176, and 178 may be repeated multiple times, or may occur only once. Also, during the step of retracting the nozzle head (step 178), the nozzle head may also be incrementally rotated clockwise (step 176). As illustrated, method may also include the step of sliding a cam reverser (slidable section, step 180) and reversing the direction of rotation of the nozzle head with the cam reverser to counterclockwise (step 182). In particular implementations, these two steps may occur after a predetermined number of repetitions (cycles, or steps) of steps 174, 176 and 178, or may occur after just one occurrence of each of steps 174, 176, and 178. In implementations of a pool cleaning head, the sliding of the cam reverser (step 180) and the reversing of the direction of rotation of the nozzle head (step 182) may be repeated automatically (along with the repetitions of steps 174, 176, and 178) a predetermined number of times or according to a predefined pattern, allowing the pool cleaning head to incrementally and intermittently rotate through a particular arc of rotation or a fully 360 degrees for a desired period of time.

Implementations of cleaning head assemblies 216 employing removable and replaceable cam assemblies 222 may also enable adjustment of the overall orientation of the direction of total rotation (whether the rotation of the stem 140 is directed toward or away from a wall, for example) through exchanging of cam assemblies 222. In a conventional cleaning head assembly, the pattern of intermittent spray is fixed and the cam teeth of the cleaning head are built into the cleaning head assembly. Replacement of the cam teeth for a different cam configuration or to replace a broken cam tooth requires replacement of the entire cleaning head assembly. An exchange or a replacement of a cam assembly 222 in particular implementations disclosed herein may be facilitated by decoupling the cap ring 136, removing the locking ring 134, removal of the cam assembly 126 and then replacement of the cam assembly 126 with another cam assembly that is either the same as the first (if repairing), or has different characteristics than the first (such as a degree of total rotation different from the first cam assembly). The locking ring 134 may be reapplied, the cleaning head oriented and its extents tested, and the cap ring 136 reapplied.

This ability to change the overall orientation of the direction of total rotation of the cleaning head assembly 124 also allows for directional adjustment after the cleaning head assembly 124 is installed in a pool floor, step, or sidewall to ensure more optimal routing of contaminants regardless of the initial installation of the cleaning head assembly 124. The foregoing may allow an installer to tune the cleaning area covered by particular implementations of a cleaning head assembly 124 and perform adjustments without requiring specialized tools or lengthy disassembly or replacement.

Figure 14:
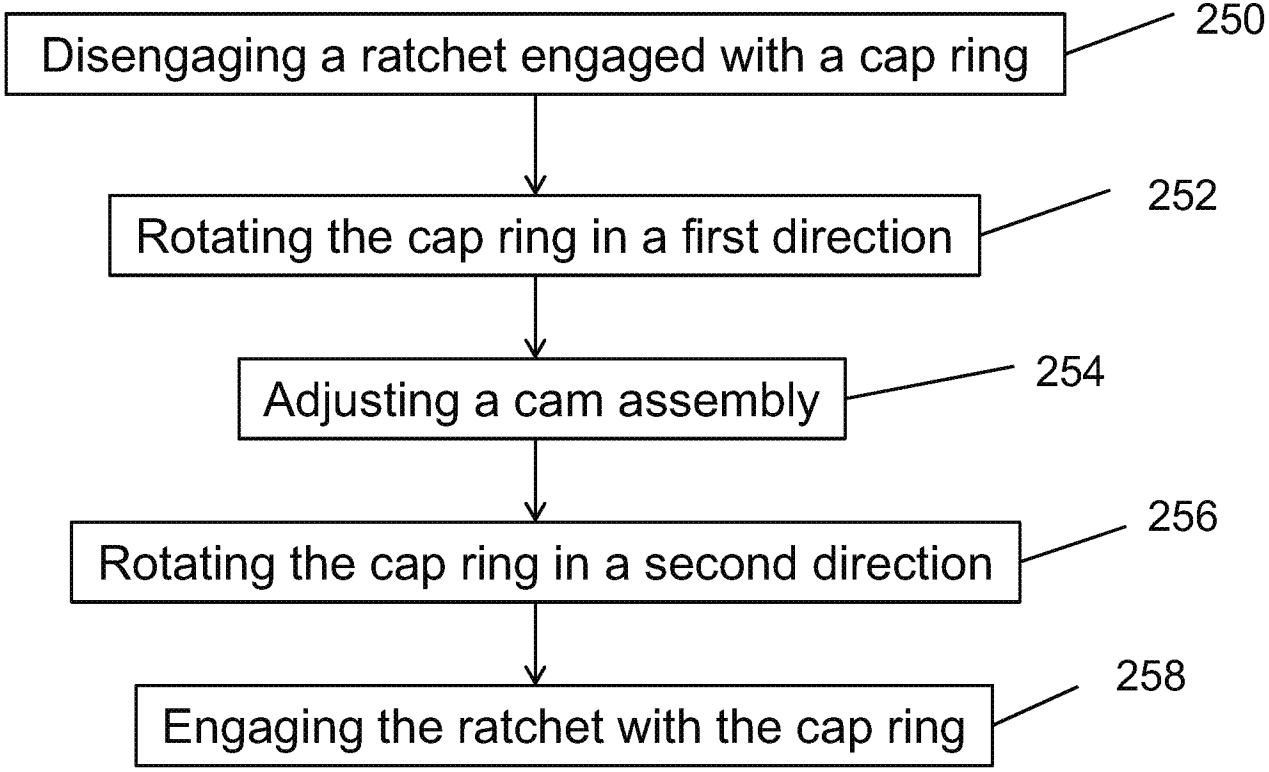
FIG. 14 is a flow diagram of an implementation of a method of adjusting a swimming pool cleaning head.

In addition, implementations of cleaning head assemblies 124 may utilize a method of adjusting the orientation of the cleaning head assembly 124 after the cleaning head assembly 124 has been installed. Referring to FIG. 14, an implementation of the method is illustrated. The method includes the steps of disengaging a locking arm 204 engaged with a cap ring 136 (step 250), rotating the cap ring 136 in a first direction (step 252), adjusting a cam assembly 126 (step 254), rotating the cap ring 136 in a second direction (step 256), and engaging the locking arm 204 with the cap ring 126 (step 258). The method may further include pressing on the locking arm 204 through an opening 206 in the cap ring 136. Rotating the cap ring 136 in a first direction (step 252) may further include disengaging a plurality of ridges 208 on a housing 132 with a plurality of grooves 210 on a lower section 130 of a cam assembly 126 and rotating the cap ring 136 in a second direction (step 256) may further include engaging the plurality of ridges 208 on the housing 132 with a plurality of grooves 210 on a lower section 130 of a cam assembly 126. Rotating the cap ring 136 in a first direction (step 252) may also include disengaging projections 214 of the cap ring 136 from ramp members 212 of a locking ring 134. Rotating the cap ring 136 in a second direction (step 256) may also include engaging projections 214 of the cap ring 136 with ramp members 212 of the locking ring 134. The first direction may be either clockwise or counterclockwise and the second direction will always be in a direction opposite the first direction. Adjusting the cam assembly 126 may include rotatably adjusting the position of the cam assembly 126 so that the path of travel of the stem 140 during automatic cleaning operation covers a desired area of the pool.

Figure 16:
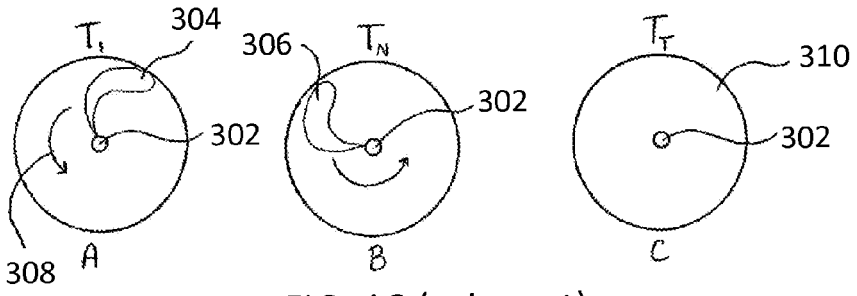
FIG. 16 (prior art)
FIG. 16 is an illustration of the flow emanating from a conventional continuous rotation cleaning head.
Figure 17:
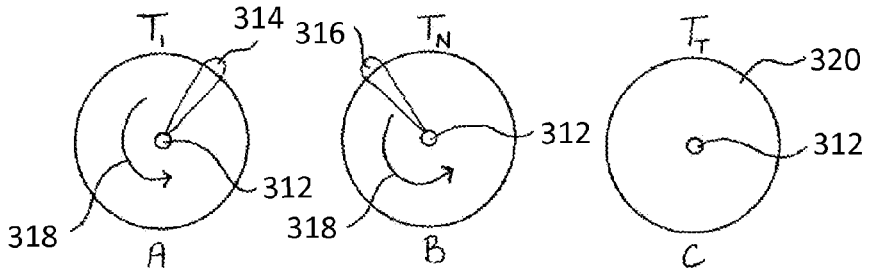
FIG. 17 (prior art)
FIG. 17 is an illustration of the flow emanating from a conventional incremental rotation cleaning head.

Any of the above described heads or cam assemblies may be placed in various locations and in any combination throughout a pool to facilitate cleaning. Swimming pool cleaning heads, as described above or as otherwise known in the art, may be utilized and/or adapted to be utilized with the various implementations disclosed herein in accordance with the principles discussed and taught. Two examples of conventional swimming pool cleaning head designs particularly useful in swimming pool floors are illustrated in FIGS. 16 and 17. FIG. 16 represents the water flow pattern of a swimming pool cleaning head having a continuously rotating water stream. An example of one particular implementation of this type of cleaning head is shown and described in U.S. Pat. No. 3,675,252 to Ghiz, issued Jul. 11, 1972, the relevant disclosure of the general operation, structure, manufacture and function of a continuously rotating cleaning head is hereby incorporated herein by reference. When water is supplied to the cleaning head, the head rotates slowly for a time period until the water supply is shut off. As shown in FIG. 16, a cleaning head 302 of a continuously rotating water stream is shown with an effective water stream 304. Note that the effective water streams 304 and 306 are shown curved for the continuously rotating cleaning heads at each of times T(1) and T(N) due to the spiraling effect of the cleaning head 302 rotating in the direction 308 while spraying the water streams 304 and 306. Throughout its 360 degree rotation for total time T(T), the conventional cleaning head 302 affects an effective area 310 of the cleaning head 302. The effective area 310 of a cleaning head 302 is affected by the water pressure provided to the cleaning head 302 and the angle and size of the cleaning head nozzle. Those of ordinary skill in the art will readily be able to adapt an appropriate cleaning head effective area to a given implementation and cleaning head layout for a particular pool. One example of a continuously rotating swimming pool cleaning head is shown in U.S. Pat. No. 3,449,772 to Werner (issued Jun. 17, 1969). Continuously rotating swimming pool cleaning heads are not used in modern pool cleaning system designs for many reasons, some of which are described in U.S. Pat. No. 3,506,489 to Baker (issued Apr. 14, 1970). Instead, incrementally rotating swimming pool cleaning heads are preferred.

Incrementally rotating in-floor swimming pool cleaning heads are conventionally associated with a circuit having one to six cleaning heads. When water pressure is applied to the circuit, each of the heads in the circuit extends and begins to spray water in whatever direction the cleaning head jet nozzle happens to be pointing when the head extends. The cleaning heads each spray the water in its respective direction until the water pressure is released and then retracts back into the pool floor until the next cycle when water pressure is applied to the circuit. At the next cycle, each cleaning head is incrementally rotated from its previous position, thus spraying water in a different direction than before. This process continues each time water pressure is applied to the cleaning heads. For conventional systems where the in-floor cleaning heads rotate 360 degrees through a number of cycles, there is a high likelihood that a first cleaning head and a second head, whether on the same circuit or different circuit within the pool, will not spray in the same direction during a particular cycle. In fact, in many cases, the first and second heads may be pointed in exactly opposite directions essentially cancelling the benefit of each other in the pool cleaning system. If, for example, the first cleaning head in a first circuit was spraying debris toward the drain for a time and then a second cleaning head extended and sprayed debris away from the drain for a time, the benefit of the work the first cleaning head did would be considerably diminished. When the cleaning heads cycle through 360 degrees with equal jet force in all directions so that the net jet force for the cleaning head is zero, the cleaning heads essentially just stir up the debris with the hope that some of it will find its way to the drain.

FIG. 17 represents the flow pattern of a swimming pool cleaning head having an incrementally rotating water stream. An example of one particular implementation of this type of cleaning head is shown and described in U.S. Pat. No. 5,135,579 to Goettl (issued Aug. 4, 1992) and U.S. Pat. No. 6,848,124 to Goettl (issued Feb. 1, 2005), the relevant disclosures of the general operation, structure, manufacture and function of an incrementally rotating cleaning head is hereby incorporated herein by reference. Incrementally rotating cleaning heads are conventionally configured to incrementally rotate in response to the start and stop of water pressure controlled by a sequence valve. For each incremental location, the flow path is stationary.

As shown in FIG. 17, a cleaning head 312 of an incrementally rotating water stream is shown with an effective water stream 314. Note that the effective water streams 314 and 316, distinct from that of a continuously rotating water stream, are shown straight for the incrementally rotating cleaning heads at each of times T(1) and T(N) due to the fixed flow path for each flow location of the cleaning head 312 as it incrementally rotates in the direction 318. Throughout its 360 degree rotation for total time T(T), the conventional cleaning head 312 affects an effective area 320 of the cleaning head 312. The effective area 320 of a cleaning head 312 is affected by the water pressure provided to the cleaning head 312 and the angle and size of the cleaning head nozzle. Those of ordinary skill in the art will readily be able to adapt an appropriate cleaning head effective area to a given implementation and cleaning head layout for a particular pool. Typically, however, for a given water pressure and nozzle size, an incrementally rotating cleaning head will have a larger effective area than that of a continuously rotating cleaning head with the same pressure and nozzle size.

Figure 18:
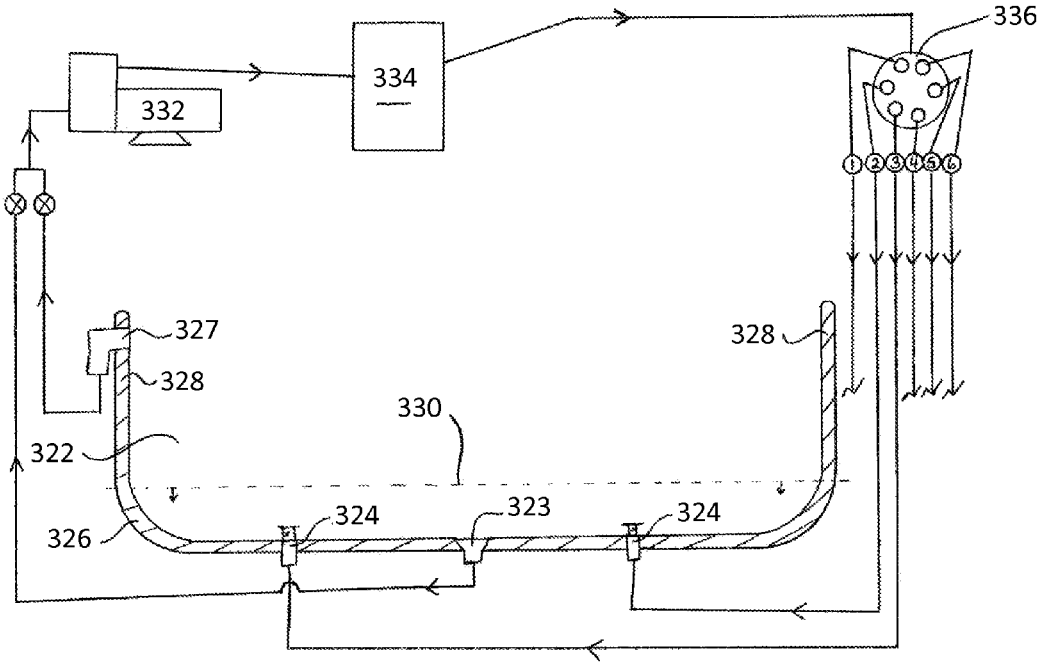
FIG. 18 (prior art)
FIG. 18 is a cross sectional view of a conventional pool with a cleaning system block diagram comprising cycling cleaning head circuits.

FIG. 18 is an example of a cross section of a conventional swimming pool. In this design, the swimming pool 322 includes pop-up cleaning heads 324 and a drain 323 in the floor 326 of the pool 322 and a skimmer opening 327 on a wall 328 of the pool. As used herein, a "wall" of a pool is any surface that is substantially vertical, and a "floor" of a pool is everything else. The floor 326 surfaces are the surfaces on which dirt and debris settle. In FIG. 18, the division between the wall 328 and the floor 326 is approximately indicated by line 330, the floor 326 being the surface below the line 330 and the wall 328 being the surface above the line 330. In conventional pool design, this line is commonly known as the "spring line."

The example of FIG. 18 also includes a swimming pool pump 332 and filter 334, and a sequencing valve 336 coupled to individual cleaning circuits 1-6. The circuits 1-6 which feed individual cleaning heads in the swimming pool in the pool floor 326. Conventional systems have a typical flow of 55-60 gallons per minute. Some pool cleaning hydraulic systems use a single pump coupled to the filter to operate the cleaning heads through the sequencing valve like that shown in FIG. 18, other systems use separate pumps for the filter and cleaning heads. Sequencing valves are used for systems having incrementally rotating cleaning heads.

Figure 19:
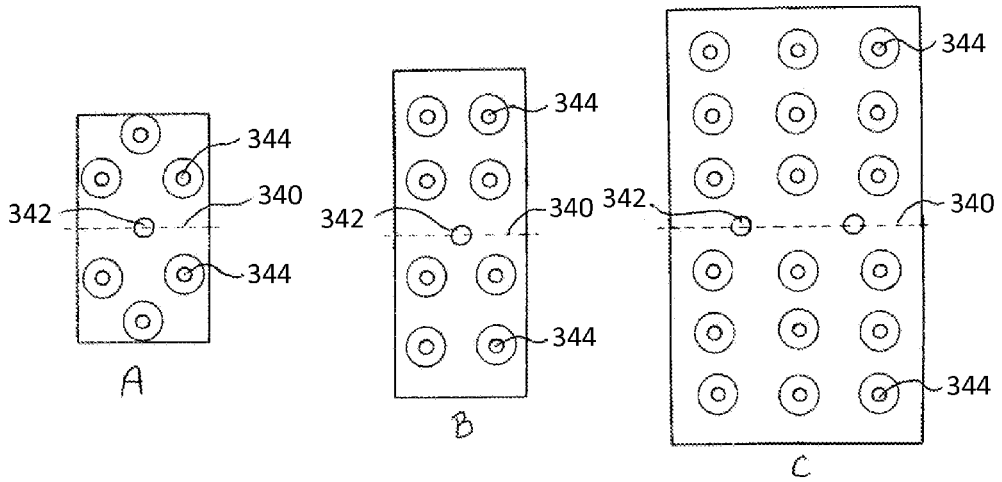
FIG. 19 (prior art)
FIG. 19 is a plan view of three differently sized conventional pools illustrating cleaning head placement and conventional operation.

FIG. 19 illustrates three examples of differently sized conventional play pools where the center line 340 of the pool is the deepest part of the pool and is the line along which the drain 342 is placed. In a conventional pool, a plurality of 360 degree rotating cleaning heads 344 are placed in the floor of the pool to stir up the dirt and debris into entrainment in the pool water. After a time, the dirt and debris will settle again to the pool floor. The hope of pool cleaning system designers using this approach is that the dirt and other debris will be stirred up into suspension in the pool water and eventually be moved to the drain or the skimmer. It is commonly known in the pool industry that for large pools, in-floor cleaning systems cannot completely clean the pool. Rather, in-floor cleaning head systems used in large pools serve to gather debris in a plurality of localized areas so that a maintenance person can vacuum the debris by hand. If the debris in the pool is not the type of debris that settles to the ground (like dirt and leaves) but can remain entrained in the water, then the entrained debris can be filtered with the water through the skimmer and drain. However, if the debris is of the type that settles to the pool floor, conventional in-floor pool cleaning heads push the debris around to different locations around the pool floor as the incrementally rotating cleaning heads jet in their uncoordinated jet directions throughout their cleaning cycles. Once the debris either finds a "dead space" where a cleaning head cannot move the debris or the cleaning system stops, the localized debris areas may be hand-cleaned by a worker with a pool vacuum cleaner.

Figure 20:
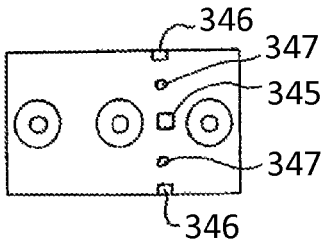
FIG. 20 (prior art)
FIG. 20 is a plan view of a conventional diving pool illustrating conventional cleaning head placement and operation.
Figure 21:
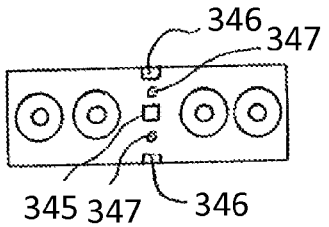
FIG. 21 (prior art)
FIG. 21 is a plan view of a conventional lap pool illustrating conventional cleaning head placement and operation.

In occasional swimming pool designs, cleaning heads are placed in the wall of a swimming pool near the surface of the water to jet down the side of the pool wall, but wall-placed cleaning heads are less effective at cleaning the floor of the pool, are suitable only for small pools without steps or benches unless floor cleaning heads are also used, and are better suited for other purposes. One example of a swimming pool design using wall-placed cleaning heads is shown in U.S. Pat. No. 4,114,206 to Franc (issued Sep. 19, 1978). FIG. 20 illustrates pool cleaning head placement for a conventional diving pool design with the drain near the deepest part of the swimming pool. FIG. 21 illustrates pool cleaning head placement for a conventional lap pool design with the drain near the center of the pool, the pool having a fairly even depth throughout its length. The conventional lap pool example of FIG. 21 also includes fixed, non-rotating wall-mounted cleaning heads 346 near the drain 345 configured to create a water curtain across the pool near the drain to catch debris moved across the plane of the water curtain and direct it toward the drain. Additional fixed direction, pop-up, non-rotating floor-mounted cleaning heads 347 may be included and directed toward the drain to further enhance the water curtain across the pool. U.S. Pat. No. 5,135,579 to Goettl (issued Aug. 4, 1992), the disclosure of which is hereby incorporated herein by reference, discloses a fixed directional cleaning head to capture debris stirred up by turbulence. An example of a swimming pool design, although it is for a diving pool design, using wall-placed and floor-placed cleaning heads is shown in U.S. Pat. No. 3,506,489 to Baker (issued Apr. 14, 1970). Baker includes floor-mounted cleaning heads with 360 degree rotation and wall-mounted cleaning heads mounted near the surface of the pool with partially rotating heads so that the water does not spray out of the pool.

Figure 22:
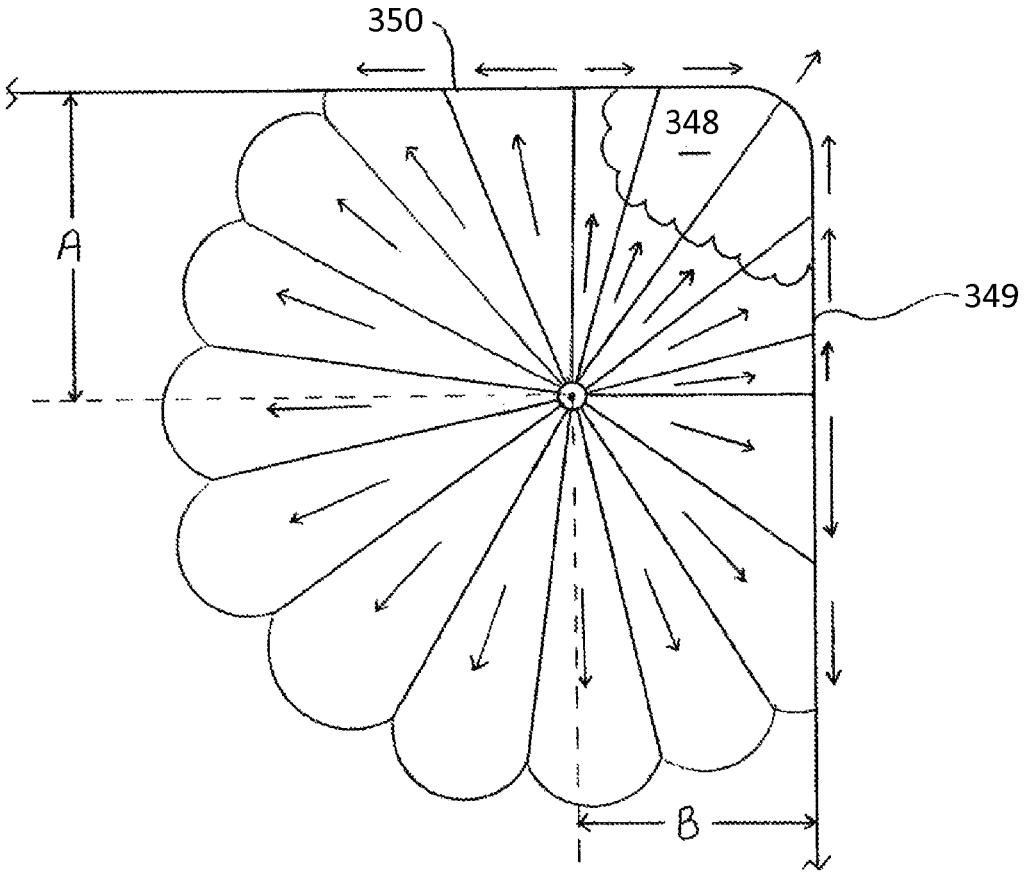
FIG. 22 (prior art)
FIG. 22 is a plan view of a conventional floor cleaning head placed near a corner of a pool illustrating conventional cleaning head placement and operation in relation to debris movement.

FIG. 22 illustrates placement of a conventional floor cleaning head in relation to a corner of a pool near an inside corner to describe operation of the cleaning head in relation to dirt and debris movement. The cleaning head of FIG. 22 is a sequentially rotating head having a jet direction radially from the cleaning head in each sequential direction. The arrows illustrate water flow movement near the edge of the effective area of the cleaning head. Debris and dirt 348 typically becomes trapped in inside corners of a pool. Distances A and B are the respective distances the floor-mounted cleaning head is placed from the first wall 349 and second wall 350 of the swimming pool. If a cleaning head is spaced equally from adjacent pool walls 349 and 350, the dirt tends to build up on the corner and is not effectively removed. Instead, however, if A and B are different distances, the cleaning head more effectively removes the dirt and debris 348 from the corner through water flow being greater in one direction than in another as the cleaning head cycles through its sequential positions. As further illustrated by FIG. 22, water flow directed toward a wall travels along the wall, thereby carrying the debris along the wall. The substantially vertical walls of a pool can affect water flow in a beneficial way if used in coordination with a water flow plan for the pool using floor-mounted cleaning heads. For small pools, 360 degree rotating cleaning heads may be effective because of the effect the side walls have on the water and debris flow. In larger pools, however, 360 degree rotating heads are well known to create piles of debris that must be hand vacuumed by a maintenance person.

Figure 23:
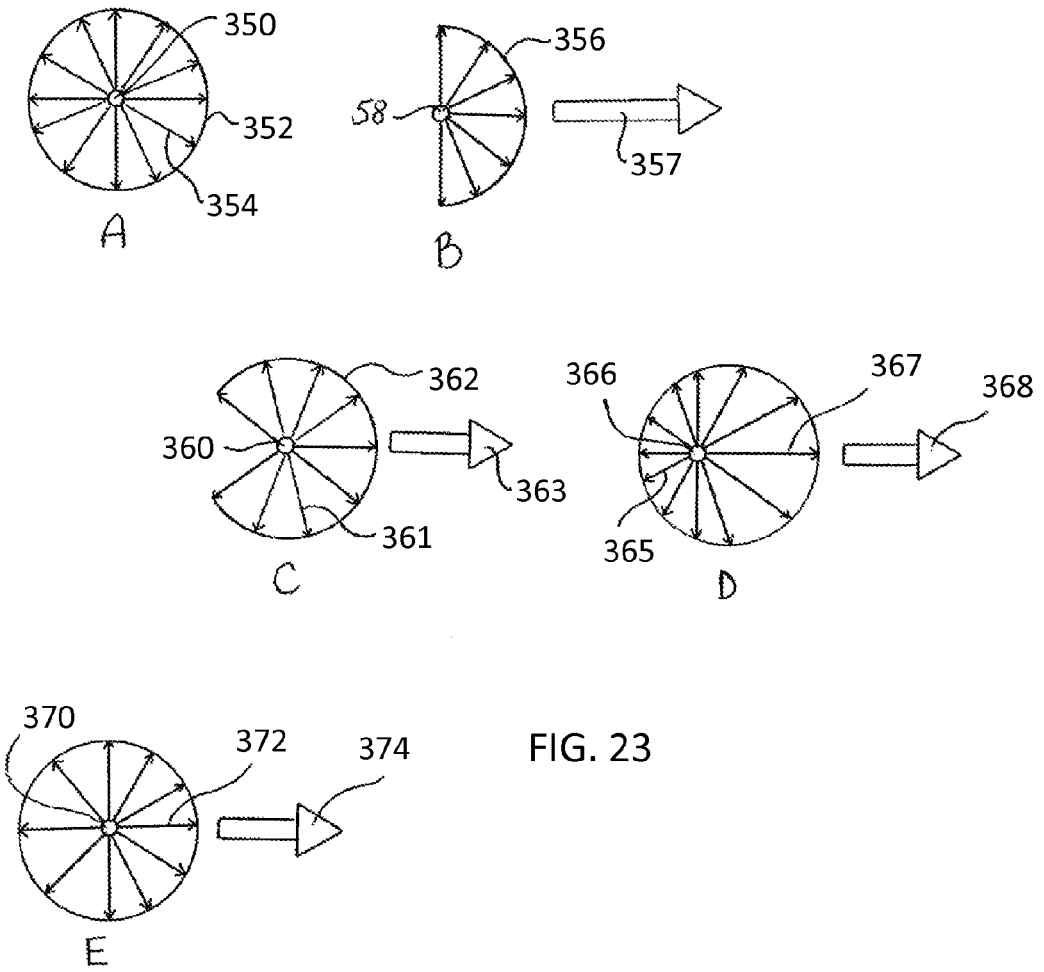
FIG. 23 illustrates different configurations of flow vectors for a pool cleaning head.

FIG. 23 illustrates a plurality of different possible jet configurations for in-floor mounted cleaning heads. Example A of FIG. 23 illustrates a conventional cleaning head configuration where the effective area 352 of the cleaning head 350 is equal around all 360 degrees and through all of its cycles. The cleaning head 350 of this example sprays with equal force and volume in each of its evenly spaced directions 354 so that the net flow direction of the water emanating from the cleaning head 350 within one cycle at each jet position is zero. The net flow vector of a cleaning head is the sum of the water flow vectors for the cleaning head for each jet direction and cycle of the cleaning head.

Example B of FIG. 23 illustrates an in-floor mounted cleaning head configuration where the effective area 356 exists in only about 180 degrees of the cleaning head 358 rotation. As a result, the net water flow 357 of the cleaning head 358 is clearly to the right of this cleaning head 358. The effective area of a cleaning head in this and other examples provided herein may be altered in any of many different ways designed to create a net water flow in a particular direction. Some non-limiting examples of how the net water flow of a particular cleaning head may be altered include, but are not limited to: 1) altering the rotation of the cleaning head to only rotate between two angular extents (such as within a 180 degree range) and either cycle back to the beginning of the rotation or flip back to the beginning; 2) allowing the cleaning head to continue its 360 rotation but disallowing water jet from the cleaning head during a portion of its rotation; 3) allowing the cleaning head to continue its 360 rotation but spending less time in particular cycles or restricting a portion of the flow during particular cycles; 4) allowing the cleaning head to continue its 360 rotation but making greater jumps in its cycle during a portion of its rotation; 5) having decreased water flow volume or pressure during a portion of the cleaning head rotation to reduce the effective water stream strength at that part of the cycle; 6) combinations of any of these or other ways of creating a net water flow in a particular desired direction; 7) deflecting the jet away from the floor in a particular section of the cleaning head rotation; and 8) using a smaller hole on one side of the head and a larger hole on another side of the head to create differential net water flow on different sides of the cleaning head.

Examples C, D and E of FIG. 23 illustrate some non-limiting examples of how differing in-floor mounted cleaning head jet configurations may allow for an in-floor mounted cleaning head with a net water flow in a particular direction. Example C illustrates a cleaning head 360 with jet directions 361 having effective jet area throughout approximately 270 degrees of the cleaning head rotation resulting in an effective area 362 for the cleaning head 360 only throughout those 270 degrees and a net water flow direction 363 for the cleaning head 360 to the right. Example D of FIG. 23 illustrates an equal number of cleaning cycle directions 365 and 367 on all sides of the cleaning head 366, but the cleaning cycles 365 on the left side of the cleaning head 366 have a smaller effective spray area than the cleaning cycles 367 on the right of the cleaning head 366. This results in a net water flow direction 368 for the cleaning head 366 to the right. Example E of FIG. 23 illustrates a fewer number of cleaning cycle directions 372 on the left side of the cleaning head 370 than on the right side resulting in a net water flow direction 374 for the cleaning head 370 to the right. These and many other examples are possible using any combination of techniques for creating a net water flow direction in a particular direction. Many other examples and how to implement the examples for use with in-floor cleaning head designs will become apparent from this disclosure. Two particular, non-limiting examples of pool cleaning heads capable of creating a net water flow direction are shown and described in U.S. Pat. No. 6,848,124 (for flush pop-up) to Goettl and U.S. Pat. No. 6,899,285 (for above surface) to Goettl et al.

Figure 24:
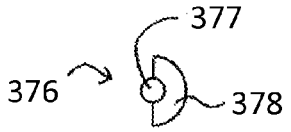
FIG. 24 illustrates a symbol for a pool cleaning head used to emphasize that the net flow vector for the cleaning head is not neutral.

FIG. 24 illustrates a symbol 376 for a pool cleaning head used to emphasize that the net flow vector for the cleaning head 377 is not neutral but is generally in the direction toward which the effective area 378 of the cleaning head 377 is facing. This symbol, or variations of it, is used throughout FIGS. 25-31 to indicate that an in-floor cleaning head is used that has a non-neutral net water flow generally in the direction of the effective area markings for the particular cleaning head illustrated.

Figure 25:
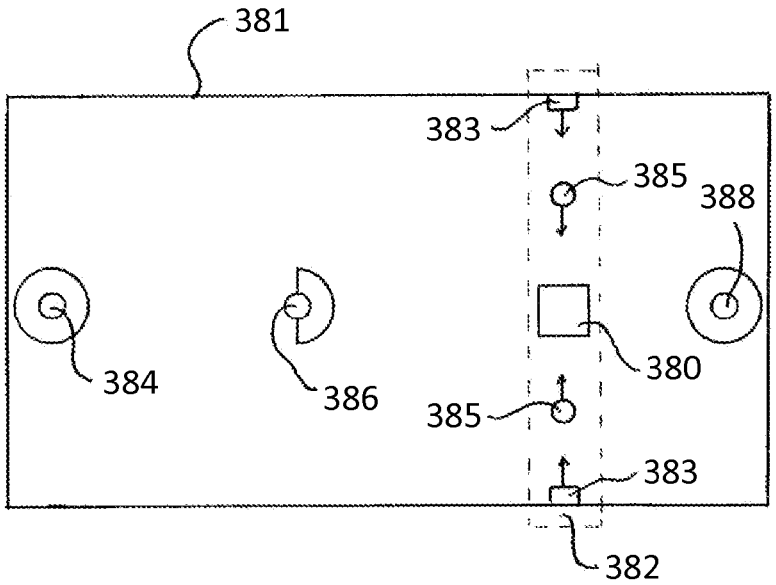
FIG. 25 is a plan view of a small diving pool illustrating cleaning head placement and operation according to a basic implementation of a pool cleaning system.

FIG. 25 illustrates an example of a basic implementation of a pool cleaning system using an in-floor cleaning head with a non-neutral net water flow direction. The example of FIG. 25, which may, for example, be implemented as a diving pool 381, includes a debris collection point 380, such as a drain, a debris capture zone 382 around the debris collection point 380, and a plurality of pool cleaning heads on the floor of the pool 381, the cleaning heads comprising at least one origin head 384 and at least one transition head 386 between the origin head 384 and the debris capture zone 382. The origin head 384 or the transition head 386 shown in FIG. 25 may comprise a recessed incrementally rotating nozzle assembly 10 or cleaning head assembly 124. The recessed incrementally rotating nozzle assembly 10 or cleaning head assembly 124 may be configured to establish various net vector flows during the incremental use. The recessed incrementally rotating nozzle assembly 10 or cleaning head assembly 124 may be further used in any combination or location described in FIGS. 24-34. The pool cleaning systems described with regard to FIGS. 23-34 are not limited to the specific incremental partially rotating cleaning heads shown and described with reference to FIGS. 1-15, but any of these particular implementations may be used in the pool cleaning systems therein described. This particular implementation also includes a second origin head 388 on the opposite side of the debris capture zone 382 from the first origin head 384.

In operation, the pool cleaning system of FIG. 25 may be coupled to a hydraulic system such as that shown in FIG. 18 to have one or more pumps, a filter and sequencing valves to operate the cleaning head circuits for the pool 381. Distinct from conventional in-floor cleaning head systems, the transition head 386 has a net flow vector toward the debris capture zone 382. It has been found that establishing a jet from a sequencing nozzle for approximately 1 minute or more establishes a flow path in the direction of the jet within the pool water. In particular implementations of this and other implementations provided herein, the transition head may be configured so that it does not have any flow in a direction away from the debris capture zone. For this example shown in FIG. 25, this means that the effective area for transition head 386 would be less than or equal to 180 degrees so that it does not spray back toward origin head 384.

In particular implementations of a pool cleaning system, such as is illustrated in FIG. 25, an opposing head 388 may be included on the other side of the debris capture zone. By having an origin head 384 at a first end of the pool in the example of FIG. 25, the effective area for the cleaning head is throughout 360 degrees and will clean out the corners of the first end of the pool to stir up the dirt and debris in that area. Cleaning heads with an effective cleaning area throughout 360 degrees of its rotation can be effective near the vertical walls of the pool. Because the origin head 384 is near the walls, as illustrated in FIG. 22, the dirt and debris is sprayed out of the corner and along the walls of the pool toward the transition head 386. Because the transition head 386 of this example has a net flow vector toward the debris capture zone 382, and particularly for this example does not emanate any water flow back toward the origin head 384, dirt and debris is only pushed toward the capture zone 382. The opposing head 388 similarly stirs up the dirt and debris from the second end of the pool and cleans out the corners of the second end of the pool which will push the dirt and debris toward the capture zone 382.

The capture zone 382 for this non-limiting example comprises a drain 380, a pair of fixed, non-rotating wall-mounted jets 383, and a pair of fixed direction, pop-up, non-rotating floor-mounted jets 385. The arrows associated with the wall-mounted jets 383 and the floor-mounted jets 385 indicate the spray direction for the jets; toward the drain 380. By having an opposing head 388 on the side of the debris capture zone 382 opposite the transition head 386, debris that flows beyond the debris capture zone 382 can be pushed back to the debris capture zone 382. This helps to keep debris within the boundary between transition head 386 and opposing head 388 to be captured in the debris capture zone 382. The water curtain generated within the capture zone by the wall-mounted jets 383 and the floor-mounted jets 385 may be cycled on and off like the other floor-mounted jets or may be turned off for portions of a cleaning cycle, but in almost all implementations will remain on throughout the cleaning cycles of the pool.

Figure 26:
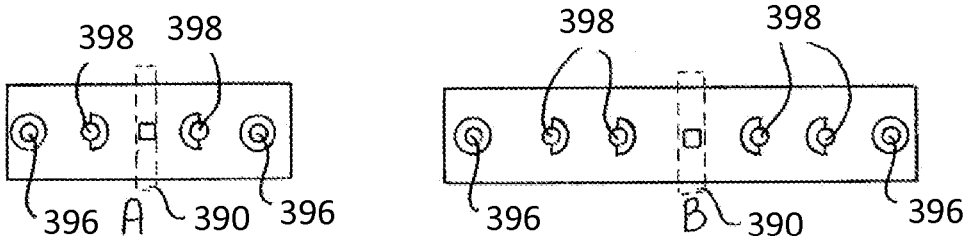
FIG. 26 is a plan view of implementations of a small play pool (A), a lap pool (B), and a larger play pool (C) illustrating cleaning head placement and operation according to particular implementations of a pool cleaning system.
Figure 26:
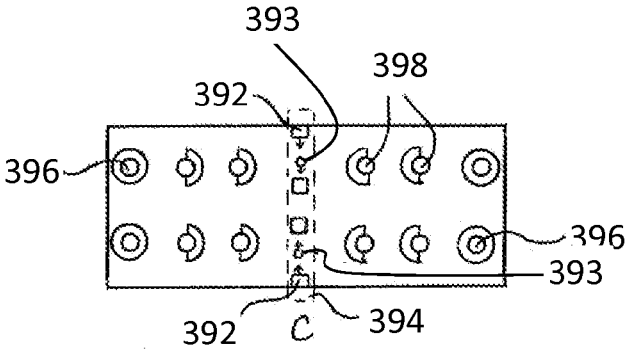

FIG. 26 illustrates three examples of how the principle of using transition cleaning heads may be applied to differently sized and configured pools where the capture zone 390 and 394 is near the center of the pool. Example A illustrates a play pool and example B illustrates a lap pool which is longer than the play pool and has two more transition cleaning heads. Each pool example comprises an origin head 396 at each end and at least one transition head 398 between the origin heads 396 and the capture zone 390. As illustrated in these two examples, the principle of placing an in-floor origin head 396 near an end of the pool and an in-floor transition head 398 between the origin head 396 and the capture zone may be expanded for longer pools by simply adding more transition heads 398 between the origin heads 396 and the capture zone. By creating a net flow vector toward the capture zone 390, and having cleaning heads with overlapping effective areas, the origin heads 396 can clean out the ends of the pool and the transition heads 398 can clean the middle portions of the pool and relay the dirt and debris toward the capture zone 390. Example C applies the principle of transition heads 398 to a wider pool with the same effect. Example C is a wider pool with a longer capture zone 394 with two drains, and pairs of side wall-mounted jets 392 and floor-mounted jets 393 creating water flow toward the drains and a water curtain to capture debris. The principle of the water flow, however, works in this pool design similar to that of the smaller examples. Wall-mounted spray jets alone are incapable of cleaning wide or large pools because the water jet effective jet area is too small. Floor-mounted spray jets with a net zero flow vector alone are incapable of cleaning wide or large pools because they randomly spray water and stir up debris. The origin head 396 or the transition head 398 shown in FIG. 25 may comprise a recessed incrementally rotating nozzle assembly 10 or one or more of cleaning head assemblies 124, 216. The recessed incrementally rotating nozzle assembly 10 or one or more of cleaning head assemblies 124, 126 may be configured to establish various net vector flows during the incremental use.

FIG. 34 illustrates a directional vector flow of water in a swimming pool resulting from pool cleaning head placement and configuration according to a particular implementation of principles disclosed herein. The arrows in the illustration represent net water flow directions. The dashed lines surrounding each cleaning head 520, 522, 524 and 526 represent the effective area of the respective cleaning heads 520, 522, 524 and 526. Note that by using origin heads 520 and 522 near the back walls of the pool, like with the example discussed in reference to FIG. 22, the resulting net water flow from the cleaning heads is along the back walls of the pool and then toward the center drain and water curtain within the debris capture zone 528. The adjacent sets of transition heads 524 and 526, which jet water toward the debris capture zone 528, adjacent walls and adjacent transition heads but not back toward the origin heads, generate an additional combined net force toward the debris capture zone 528 when the jets from a transition head set 524 or 526 cross with each other.

Figure 27:
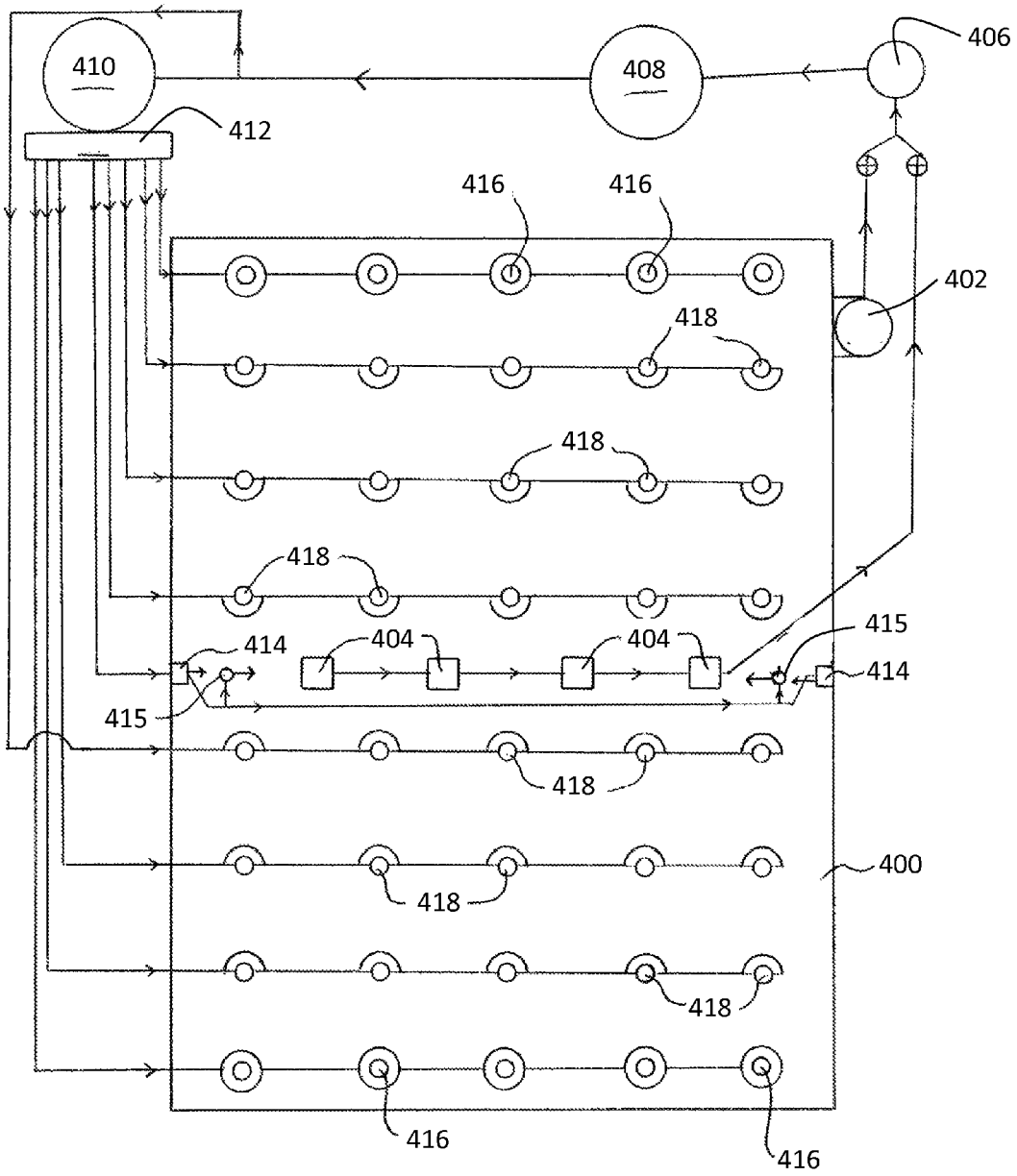
FIG. 27 is a plan view of a very large pool implementation illustrating cleaning head placement and operation according to a particular implementation of a pool cleaning system.

FIG. 27 is a plan view of a very large pool implementation illustrating cleaning head placement and operation according to a particular implementation of a pool cleaning system. In this particular implementation of a swimming pool cleaning system comprises a swimming pool 400 having a skimmer 402 and a plurality of drains 404 coupled to a pump 406. The pump 406 pumps water from the pool 400 to a filter 408 which is subsequently pumped through a sequencing valve 410 coupled to a plurality of water circuits through a circuit controller 412. The circuit controller 412 may be a conventional mechanical or electrical system configured for regulating flow of water through the sequencing circuit. Furthermore, one or more of the water circuits may be configured to be continuously on, such as the circuit supplying the side jets 414 and floor jets 415 for the capture zone, by either bypassing the sequencing portion of the system or otherwise configuring the system for the desired flow. Each of the circuits may have one or more cleaning heads 414, 415, 416 and 418. Given the principles discussed herein, those of ordinary skill in the art will readily be able to configure a conventional water circuit system for operation with an implementation of a swimming pool cleaning system disclosed. One problem commonly experienced in cleaning large pools using conventional methods is that not all of the cleaning heads on a particular row may be able to be on the same circuit. This means that the cleaning heads on part of a particular row may come on at a different time than the cleaning heads on another part of the row. This further complicates getting debris to the drains when net zero flow vector cleaning heads are used.

The example of FIG. 27, like that of FIGS. 25 and 26, includes both origin heads 416 and transition heads 418 between the origin heads and the capture zone defined about the drains 404 between the wall-mount side jets 414 and the floor-mount jets 415. Although in this example each row of cleaning heads is shown as being coupled to a different water circuit, any of the cleaning heads may be coupled with any of the other cleaning heads in the same circuits or different circuits. It has been found that cycling through the circuits by starting with the region farthest from the capture zone first (i.e. the origin heads row) followed by sequentially cycling through rows closer to the capture zone to relay the debris and dirt toward the capture zone works best. The sequencing, by non-limiting example, could begin with the outer two origin head rows first, then move to the second outer row, then the second closest row, then the closest row last. Alternatively, by non-limiting example, the sequencing could alter beginning with the first pool end origin head row then the second pool end origin row, and then alter in toward the center in a similar fashion. Virtually any combination is possible and those of ordinary skill in the art will quickly determine the cycle order that works best for a particular swimming pool configuration from the examples and principles disclosed herein without undue experimentation. While some sequencing methods may provide better results than others, beneficial results from this system is not sequencing method dependent.

Contrary to conventional systems which rotate 360 degrees and merely stir up the debris with the hope that it will settle closer to the drain even when it is sprayed back toward the ends of the pool, the use of a transition heads increases the likelihood that the dirt and debris will settle closer to the drain because the transition heads have a greater tendency to not spray the dirt and debris back toward the origin head it came from. In essence, the use of transition heads helps to create a dirt and debris flow within the pool from a dirt and debris origin toward the capture zone rather than randomly stirring up the dirt and debris with the hope that it will settle in a better place.

A study was performed in which three pool cleaning systems were compared to determine the effectiveness of using transition heads for cleaning a swimming pool. All three pool cleaning systems used the same swimming pool with the heads located in the pool according to different cleaning head layout theories. All of the cleaning heads were incrementally cycling pop-up heads. For each test demonstration, approximately 400 synthetic leaves cut into 1½ inch triangles of vinyl sheeting were placed in the swimming pool prior to the cleaning system being turned on. The cleaning system was left on for one hour in each test demonstration and each test demonstration used the same pumping systems, but with a different cleaning head layout. Three separate test demonstrations were performed for each pool cleaning system. The first pool cleaning system used no water curtain and rows of adjacent cleaning heads in the pool; the second pool cleaning system used fewer but larger cleaning heads and a water curtain; and the third pool cleaning system used a water curtain and cleaning heads like the second pool cleaning system, but some of the cleaning heads were substituted to include transition heads and arranged as explained in relation to the principles discussed for the examples of FIGS. 25 through 27.

For the first pool cleaning system with no water curtain and two rows of cleaning heads, the three test demonstrations resulted in, respectively, 18, 19 and 48 leaves being collected with an average of 28 leaves per test. For the second pool cleaning system with a water curtain and incrementally rotating heads each rotating through 360 degrees, the three test demonstrations resulted in, respectively, 239, 138 and 143 leaves being collected with an average of 173 leaves per test. For the third pool cleaning system with the water curtain and incrementally rotating heads where some were transition heads, the three test demonstrations resulted in, respectively, 382, 356 and 326 leaves being collected with an average of 355 leaves per test. These tests indicate a significant increase (greater than 100%) in effectiveness through the use of transition heads over a conventional system having no in-floor transition heads.

Figure 32:
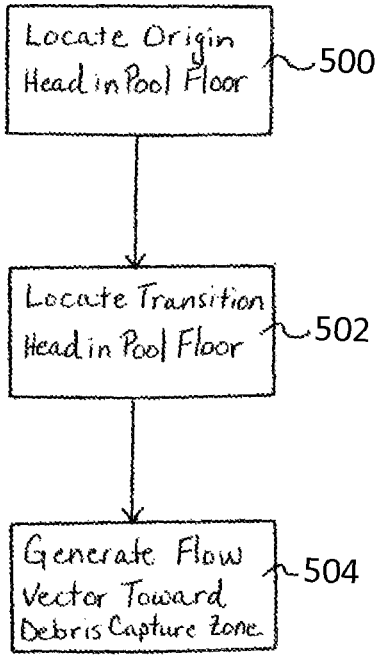
FIG. 32 is a flow diagram of a first method of designing a pool cleaning system.

Now referring to FIG. 32, a first method of designing and/or building a pool cleaning system with a predictable cleaning result is illustrated. Once a pool shape is designed, a pool cleaning system designer determines a location for one or more debris capture zones for the pool around debris capture points. In a pool configuration with a shape and one or more debris capture points, at least one debris origin point is identified and an origin head is located in the pool floor near the debris origin point (Step 500). Once the origin head is located, one or more transition head points are identified between each origin head and the debris capture point and at least one transition head is located between each origin head and the debris capture point (Step 502). The transition heads are each configured to generate a net water flow vector in the direction of the debris capture zone. Accordingly, the cleaning head system generally creates a flow vector toward the debris capture zone when in use (Step 504). This process, as demonstrated in this disclosure, is applicable to pools of any size and shape.

Figure 33:
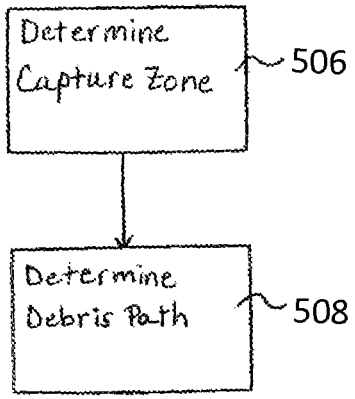
FIG. 33 is a flow diagram of a second method of designing a pool cleaning system.

Now referring to FIG. 33, a second method of designing and/or building a pool cleaning system with a predictable cleaning result is illustrated. Once a pool shape is designed, a pool cleaning system designer determines a location for one or more debris capture zones (Step 506) for the pool around debris capture points. After the debris capture zone(s) is determined for the pool, the pool cleaning system designer determines a debris path (Step 508) for debris within the pool to the debris capture zone(s). Once the debris path is determined, the method of FIG. 32 may be performed to generate a flow vector toward the debris capture zone.

Figure 30:
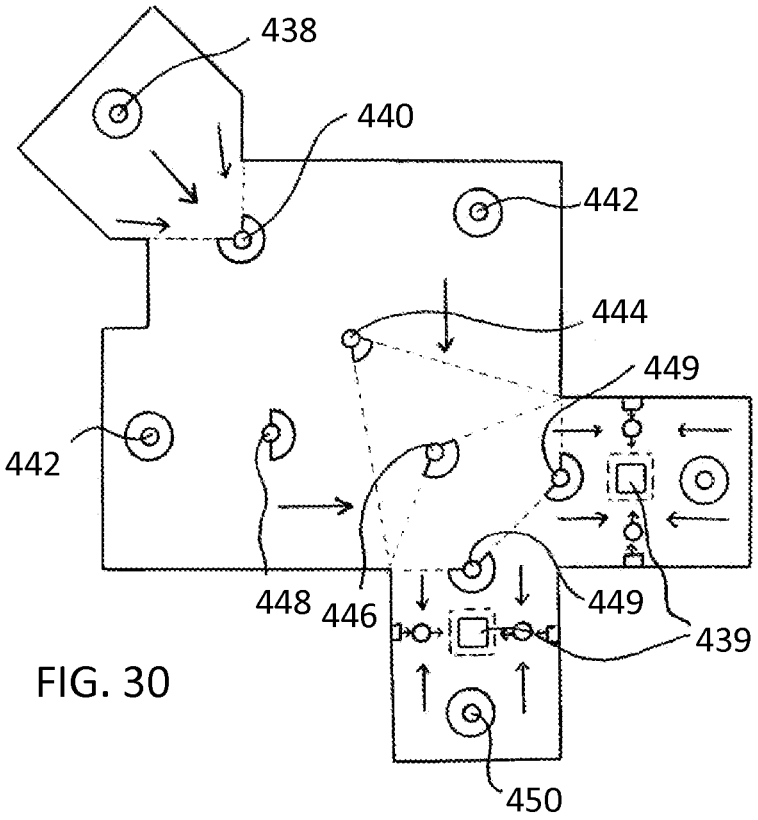
FIG. 30 is a plan view of another complicated pool implementation illustrating cleaning head placement and operation according to a particular implementation of a pool cleaning system.
Figure 31:
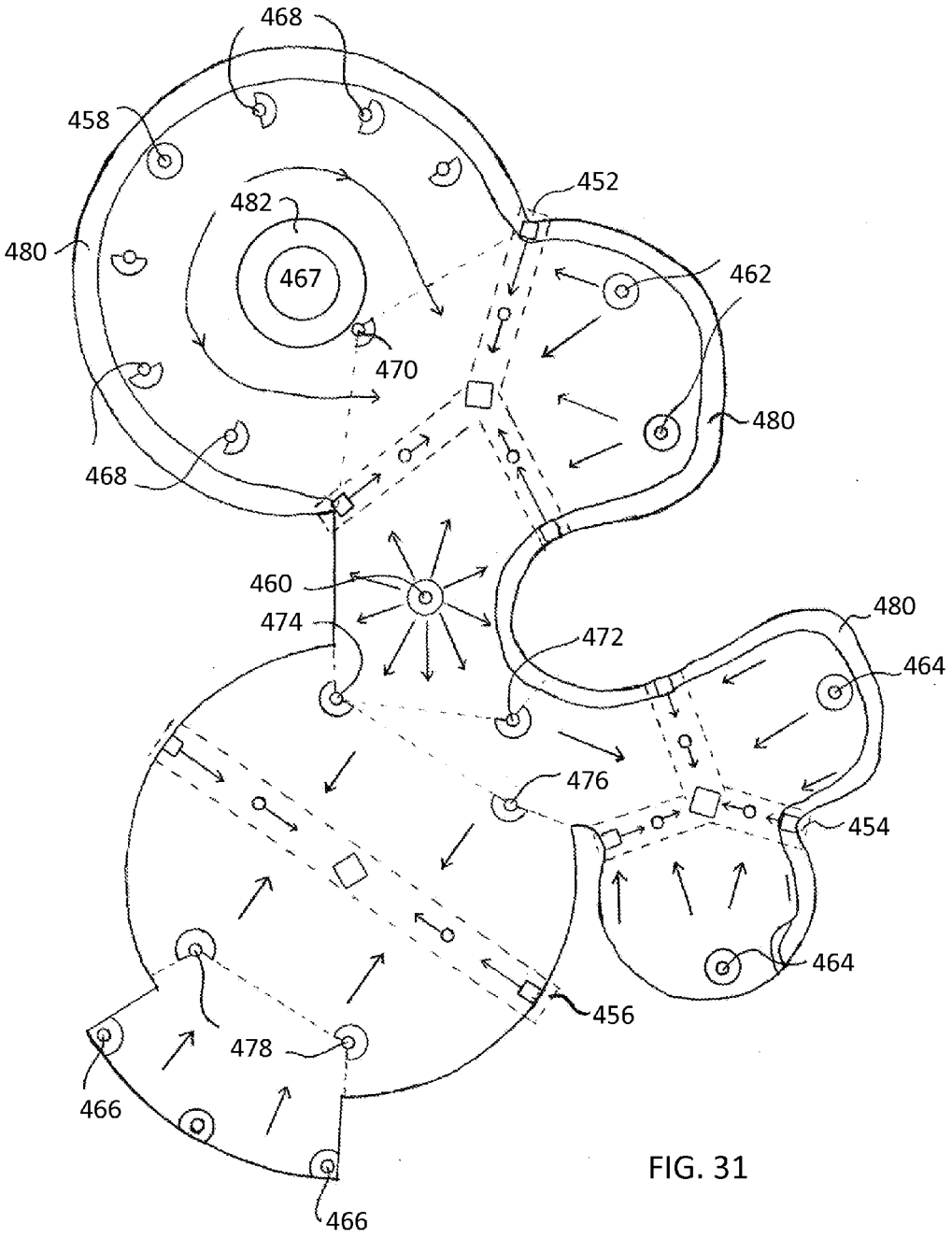
FIG. 31 is a plan view of yet another complicated pool implementation illustrating cleaning head placement and operation according to a particular implementation of a pool cleaning system.

As shown with specific regard to FIGS. 30 and 31, use of these principles enables a pool cleaning system designer to design a pool cleaning system capable of more effectively cleaning pools that it was not possible to effectively under prior art systems using conventional cleaning head arrangements. By applying additional water flow vector modules, each comprising at least one origin head and at least one transition head, to a swimming pool design, and expanding each water flow vector module to the necessary length by adding additional transition heads between the origin head and the debris capture zone, a swimming pool designer can pre-determine net water flow paths for the pool cleaning system and more effectively channel debris to the debris collection point within the pool.

Using conventional pool cleaning system design techniques, a pool was considered "cleaned" if the effective area of the cleaning heads in the pool were enough to cover the area so that all of the surfaces in the pool were sprayed. Using this type of design technique, however, there was no way to predict where the dirt would go. The result was that after the pool was designed and built, if the pool was not effectively cleaned and piles of dirt and debris was left on the pool floor, the contractor would need to come out and redo the cleaning system. Redoing a pool cleaning system can be a very expensive and time consuming process because many times parts of the pool must be demolished to replace the cleaning heads. In a particular method of designing and/or making a pool cleaning system, the pool cleaning system is configured so that the cleaning heads associated with a first circuit are farthest away from a debris capture zone, the cleaning heads associated with a second circuit are next closest to the debris capture zone, and the cleaning heads associated with a third circuit are closest to the debris capture zone. In this particular implementation, the circuits are supplied water and sequentially activated in the order farthest away from the debris capture zone to closest to the debris capture zone. In this way, debris farthest from the debris capture zone is stirred up toward the capture zone and is then transitioned to the next circuit's cleaning heads which are closer to the debris capture zone, etc. If the implementation uses transition heads in one or more intermediate circuits, the debris will more consistently be pushed toward the debris capture zone than if conventional 360 degree rotating, zero net flow value heads are used for all circuits.

Figure 28:
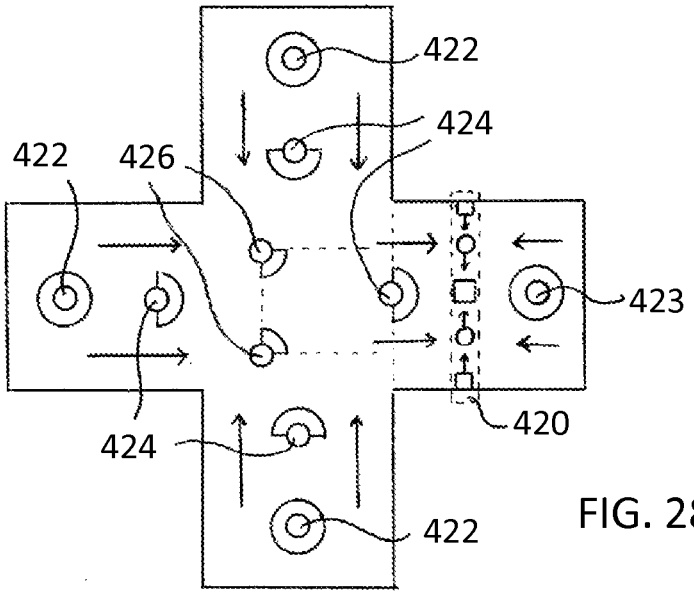
FIG. 28 is a plan view of a pool implementation having outside corners illustrating cleaning head placement and operation according to a particular implementation of a pool cleaning system.

The example illustrated in FIG. 28 is an implementation of a principle of pool cleaning system design applied to a swimming pool of substantially uniform shape having outside corners. The swimming pool comprises a debris capture zone 420, at least one origin head 422 in each leg of the swimming pool, at least one transition head 424 between each origin head and the debris capture zone 420, and an opposing head 423 in an opposing side of the debris capture zone 420 from the origin heads 422. The effective area of each cleaning head for this particular implementation is approximately 15 feet in diameter. For this particular implementation, the transition heads 424 have an effective area not greater than 180 degrees so that they do not generate any flow back toward the origin head 422 for the respective leg in which the transition head 424 is placed. This particular implementation also comprises two additional transition heads 426 configured with an effective flow area adjusted to generate flow into the leg of the pool having the debris capture zone and not toward any of the other legs of the pool.

Figure 29:
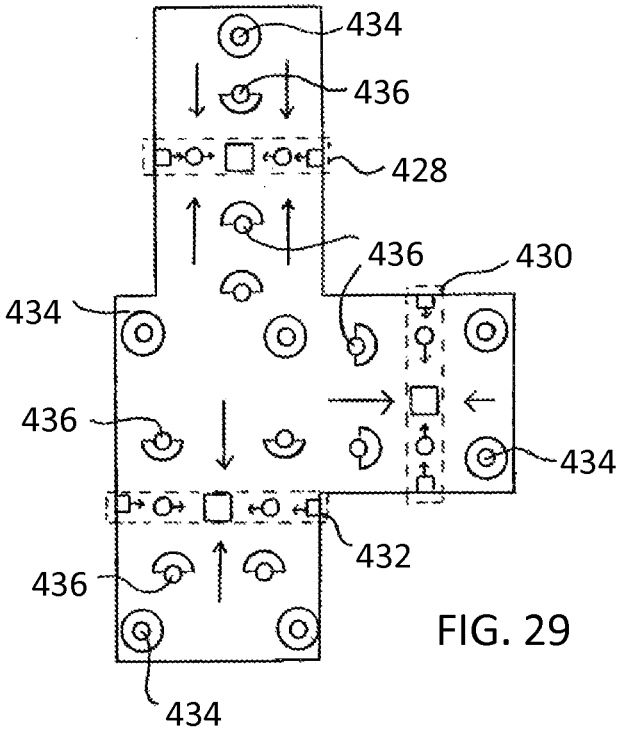
FIG. 29 is a plan view of a more complicated pool implementation having multiple capture zones illustrating cleaning head placement and operation according to a particular implementation of a pool cleaning system.

The example illustrated in FIG. 29 is an implementation of a principle of pool cleaning system design applied to a swimming pool having outside corners but a non-uniform pool shape and multiple capture zones. In this pool design there are three debris capture zones 428, 430 and 432. Each of the debris capture zones 428, 430 and 432 for this implementation comprises at least one drain in the pool floor and fixed directional cleaning heads on opposing side walls and the floor adjacent the drain, the fixed directional cleaning heads spraying toward their respective drain.

The origin and transition pool cleaning heads are configured a little differently for each debris capture zone due to the shape of the pool. For this particular pool shape, it was determined that a debris origin point near a center of the largest open space for the pool was appropriate. Accordingly, an origin head 434 was placed there, one near the outside corner between the first and second capture zones 428 and 430 and one near the corners between the first and third capture zones 428 and 432. Transition heads 436 were placed between these central origin heads 434 and each debris capture zone 428, 430 and 432. Each of the transition heads is configured to generate a net water flow vector toward a particular debris capture zone. For the first debris capture zone 428, a net flow vector module comprising an origin head 434 and a transition head 436 are placed between the end of the pool and the debris capture zone. In this way, the transition head 436 acts as an opposing head for the net flow vector module on the opposite side of the debris capture zone. There is no requirement implied for any implementation of a pool cleaning system that the opposing head be a cleaning head configured for 360 degree rotation. The effective area of each cleaning head for this particular implementation is approximately 14 feet in diameter. Various implementations will use cleaning heads suitable for the particular implementation. Effective areas for cleaning heads typically vary from a 2 to a 10 foot radius depending on the cleaning head and the associated pumping system. For the second debris capture zone 430, two origin heads 434 were used as the opposing heads for the capture zone 430. For the third debris capture zone 432, like the first one 428, origin heads 434 and transition heads 436 were used. As is illustrated by this implementation, whether to use transition heads and how many transition heads are needed depends upon the specific pool shape and size and the effective area of each origin and transition head. Once the basic principles of implementing a pool cleaning system using net flow vector modules is understood, one of ordinary skill in the art will readily be able to design and implement a pool cleaning system for any pool shape using the basic principles. Two particular, non-limiting examples of pool cleaning heads capable of creating a net water flow direction are shown and described in U.S. Pat. No. 6,848,124 (for flush pop-up) to Goettl and U.S. Pat. No. 6,899,285 (for above surface) to Goettl et al.

The swimming pool implementation shown in FIG. 30 is an implementation that cannot be effectively cleaned using conventional swimming pool cleaning system design principles. However, using net flow vector module principles, an effective pool cleaning implementation was designed. This particular implementation comprises a plurality of differently configured cleaning heads, each configured for its particular position in the pool. A first origin head 438 is included in the floor of the pool. This origin head 438, although it is configured for 360 degree rotation, may be configured with a net flow vector toward the opening to the main body of the pool to better channel debris toward the debris collection points 439. While this implementation illustrates only a drain within the debris capture zone, it should be understood that fixed directional cleaning heads (see FIG. 27) may be implemented in the wall and floor of the pool adjacent the drains 439 to create wider debris capture zones. It should also be understood that for any of the implementations disclosed herein, a debris capture zone may comprise a plurality of transition cleaning heads having net flow vectors toward and surrounding the drain to enlarge the debris capture zone. This approach may be particularly useful for a drain that is not near a wall, such as in a large public pool.

At the edge of the main body of the pool in FIG. 30, a transition head 440 is configured for an effective area covering approximately 270 degrees with a net flow vector toward the two debris collection points 439. Note that in this implementation, the transition head 440 is configured so that it does not spray water back toward the origin head 438. The dashed lines indicate the boundaries of the effective areas of the transition heads in this implementation. Two origin heads 442 are included near the inside corners for the pool. Between the two origin heads 442, two more narrowly configured transition heads 444 and 446 are configured to direct water flow toward the debris capture points 439. Due to the space between the left side origin head 442 and the debris capture zones, an additional transition head 448 is included. One transition head 449 is included at the opening to each of the debris capture legs of the pool and the effective area for each transition head 449 is directed only within the openings to the debris capture legs of the pool so that debris is not blown out to the main body of the pool by these transition heads. The debris capture zones 439 may further be enhanced by adding side wall and floor fixed directional heads. Finally, two opposing heads 450 are included on the opposite side of the debris capture point from the transition cleaning heads 449.

Using conventional in-floor cleaning heads with a zero net flow vector in this pool cannot effectively clean the pool due to the shape of the pool. Debris is repeatedly stirred up, the shape of the pool does not allow for effective settling near a debris collection point. Implementation of net flow vector modules in this pool enabled effective cleaning where it was previously not possible. In particular implementations of a transition head, the transition head is alignable during installation to allow for adjustment of the net water flow vector for the cleaning head. Two particular, non-limiting examples of alignable pool cleaning heads are shown and described in U.S. Pat. No. 6,848,124 (for flush pop-up) to Goettl and U.S. Pat. No. 6,899,285 (for above surface) to Goettl et al.

Like the implementation of FIG. 30, the swimming pool implementation of FIG. 31 is one that cannot be effectively cleaned using conventional swimming pool cleaning system design principles. Using net flow vector design principles, however, each of the various features of this swimming pool may be effectively cleaned. Three debris capture points are selected for this pool at each of three remote locations. Each of the debris capture points comprises at least two fixed directional jet heads in a wall of the pool and at least two fixed directional jet heads in the floor of the pool directing water jets toward the debris capture point. These groupings each form respective debris capture zones 452, 454 and 456 for the pool. The positioning of the directional jet heads is determined based on the pool shape and debris capture point location.

Once the debris capture zones were identified, debris origin points are identified and origin heads 458, 460, 462, 464 and 466 are placed in the design near the debris origin points. For the island water feature 467, a first origin head 458 is placed at a point around the island 467. Note that a bench 480 surrounds a portion of the outer edge of the pool and a bench 482 surrounds the island feature 467, thus making wall surface mount cleaning heads such as those disclosed in U.S. Pat. No. 4,114,206 to Franc (issued Sep. 19, 1978) unusable for these locations. Transition heads 468 are placed around the island, each having a net water flow vector away from the previous transition head to create a net water flow vector for the group away from the origin head 458 and toward the debris capture zone 452. Thus, although a particular transition head 468 may not have a net flow vector directly pointing to the debris capture zone, it should be considered as having a net flow vector in the direction of the debris capture zone due to the shape of the pool, the influence of the vertical pool walls on the water flow, and the surrounding transition heads because the transition head 468 assists in generating a net water flow vector toward the debris capture zone. A transition head 470 is included at the opening of the island feature 467 to further reinforce the net water flow vector created by the transition heads 468 toward the debris capture zone 452.

Central to the overall pool configuration, an origin head 460 is placed. It is determined that flow from the origin head 460 will go directly to debris capture zone 452, and to transition head 472 to debris capture zones 454 and 456 and to transition heads 474 and 476 to debris capture zone 456. Transition heads 472, 474 and 476 are placed accordingly in the design. In remote locations of the pool opposite the debris capture zones 452 and 454, origin heads 462 and 464 are included and also serve as opposing heads to the respective debris capture zones 452 and 454. Finally, origin heads 466 are placed for the beach entry and transition heads 478 are included between the origin heads 466 and the debris capture zone 456.

It will be understood that implementations are not limited to the specific components disclosed herein, as virtually any components consistent with the intended operation of a method and/or system implementation for a nozzle assembly may be utilized. Accordingly, for example, although particular nozzle assemblies may be disclosed, such components may comprise any shape, size, style, type, model, version, class, grade, measurement, concentration, material, weight, quantity, and/or the like consistent with the intended operation of a method and/or system implementation for a nozzle assembly may be used.

In places where the description above refers to particular implementations of nozzle assemblies, it should be readily apparent that a number of modifications may be made without departing from the spirit thereof and that these implementations may be applied to other nozzle assemblies. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A swimming pool cleaning head, comprising:

a cam housing;

a stem rotatably extending through the cam housing and comprising an outlet configured to eject an intermittent stream of water therethrough under water pressure force;

a nozzle head positionally coupled to the stem and positioned at least partially within the housing, the nozzle head comprising at least one of a reversing tab or a pin extending therefrom;

a cleaning head assembly positioned within the housing and at least partially around the stem, the cam assembly comprising a slidable section rotatable within the housing between a first extent and a second extent responsive to contact from reversing tab or pin, wherein the nozzle head changes a direction of rotation responsive to rotation of the slidable section from the first extent to the second extent.

2. The swimming pool cleaning head of claim 1, wherein the cam assembly further comprises an upper section, a lower section coupled to the upper section with the slidable section positioned between the upper section and the lower section, and a plurality of saw tooth members, and wherein the at least one pin is configured to incrementally rotate the stem and the nozzle head in a first direction in intermittent contact with the plurality of saw tooth members during vertical translation of the stem through water pressure force, and slidably rotate the rotatable section of the cam assembly from its first extent to its second extent.

3. The swimming pool cleaning head of claim 2, wherein the cam assembly is configured to automatically reverse the incremental rotation of the stem to a second direction opposite the first direction when the rotatable section of the cam assembly is rotated to its second extent.

4. The swimming pool cleaning head of claim 3, wherein the upper section and the lower section of the cam assembly are positionally coupled to one another such that they do not rotate with respect to each other.

5. The swimming pool cleaning head of claim 4, wherein:

the upper section comprises a plurality of saw tooth members and a reverser stop recess;

the lower section comprises a plurality of saw tooth members and a reverser stop recess aligned with the reverser stop recess of the upper section;

the slidable section comprises a plurality of saw tooth members, a reverser arm, and a reverser stop lug slidable within the aligned reverser stop recesses of the upper and lower sections between the first extent and the second extend; and the nozzle head comprises a first reverser tab and a second reverser each positioned to engage with the reverser arm, wherein when the first reverser tab engages the reverser arm the slidable section rotates to the first extent, and when the second reverser tab engages the reverser arm the slidable section rotates to the second extent.

6. The swimming pool cleaning head of claim 5, wherein the second reverser tab is removably coupled to the nozzle head and a degree of nozzle head rotation between the first extent and the second extent is adjustably dependent upon positioning of the second reverser tab.

7. The swimming pool cleaning head of claim 6, wherein the first reverser tab is removably coupled to nozzle head.

8. The swimming pool cleaning head of claim 6, further comprising:

a clamp ring coupled to the housing and configured to hold the cam assembly within the housing;

one or more retainer installation lugs extending from the housing and positioned to selectively engage with body installation lugs of a body embedded in a pool surface to allow installation of the swimming pool cleaning head in only one direction.

9. The swimming pool cleaning head of claim 6, wherein the degree of nozzle head rotation is adjustable between approximately 23 and 360 degrees.

10. A swimming pool cleaning head assembly, comprising:

a cam housing comprising a cam assembly within the cam housing, the cam assembly comprising an upper section comprising a first plurality of pin guides, a lower section positionally coupled to the upper section and comprising a second plurality of pin guides, and a slidable section positioned at least partially between the upper section and the lower section and comprising a third plurality of pin guides slidably mounted between the first plurality of pin guides and the second plurality of pin guides, the slidable section rotatable between a first extent and a second extent;

a stem extending through the cam assembly;

a nozzle head positioned at least partially within the cam assembly, the nozzle heading comprising at least one pin slidably engaged within the cam assembly between the first plurality of pin guides and the second plurality of pin guides, wherein rotation of the slidable section alters a pin path of the at least one pin through the first, second, and third plurality of pin guides, and rotation of the slidable section from the first extent to the second extent reverser a direction of travel for the at least one pin along the pin path.

11. The swimming pool cleaning head assembly of claim 10, wherein the first plurality of pin guides are formed between a first plurality of saw tooth members on the upper section, the second plurality of pin guides are formed between a second plurality of saw tooth members on the lower section, and the third plurality of pin guides are formed between a third plurality of saw tooth members on the slidable section.

12. The swimming pool cleaning head assembly of claim 11, wherein the at least one pin is configured to incrementally rotate the stem in a first direction in intermittent contact with the first, second, and third pluralities of pin guides during vertical translation of the stem through water pressure force applied to the stem, and slidably rotate the rotatable section of the cam assembly from the first extent to the second extent.

13. The swimming pool cleaning head assembly of claim 12, wherein:

the upper section and lower section each comprise a reverser top recesses aligned with one another;

the slidable section comprises a reverser arm and a reverser stop lug, the reverser stop lug being positioned and slidable within the aligned reverser stop recesses between the first extent and the second extent;

the nozzle head comprises a first reverser tab and a second reverser each positioned to engage with the reverser arm, wherein when the first reverser tab engages the reverser arm the slidable section rotates to the first extent, and when the second reverser tab engages the reverser arm the slidable section rotates to the second extent.

14. The swimming pool cleaning head of claim 13, wherein the second reverser tab is removably coupled to the nozzle head and a degree of nozzle head rotation between the first extent and the second extent is adjustably dependent upon positioning of the second reverser tab.

15. The swimming pool cleaning head of claim 14, wherein the first reverser tab is removably coupled to nozzle head.

16. The swimming pool cleaning head of claim 14, further comprising a clamp ring coupled to the housing and configured to hold the cam assembly within the housing.

17. The swimming pool cleaning head of claim 15, wherein the degree of nozzle head rotation is adjustable between approximately 23 and 360 degrees.

18. A swimming pool cleaning head assembly, comprising:

a housing;

a cam assembly comprising an upper section, a lower section coupled to the upper section, and a slidable section positioned at least partially between the upper section and the lower section, the slidable section being slidable between a first extend and a second extent;

a stem rotatably extending through the housing and at least partially into the cam assembly, the stem configured to allow a water pressure force therethrough;

a nozzle head positionally coupled to the stem, the nozzle head comprising at least one pin engaged with the cam assembly, wherein the slidable section is slidable between the first extent and the second extent responsive to the at least one pin to change the direction of rotation of the nozzle head when the water pressure force is passing therethrough.

19. The swimming pool cleaning head assembly of claim 18, wherein the cam assembly comprises a plurality of saw tooth members and the at least one pin is configured to incrementally rotate the stem in a first direction in intermittent contact with the plurality of saw tooth members during vertical translation of the stem through water pressure force, slidably rotate the rotatable section of the cam assembly from its first extent to its second extent, and automatically reverse the incremental rotation of the stem to a second direction opposite the first direction when the rotatable section of the cam assembly is rotated to its second extent.

20. The swimming pool cleaning head assembly of claim 19, the upper section and lower section each comprise a reverser top recesses aligned with one another;

the slidable section comprises a reverser arm and a reverser stop lug, the reverser stop lug being positioned and slidable within the aligned reverser stop recesses between the first extent and the second extent;

the nozzle head comprises a first reverser tab and a second reverser each positioned to engage with the reverser arm, wherein when the first reverser tab engages the reverser arm the slidable section rotates to the first extent, and when the second reverser tab engages the reverser arm the slidable section rotates to the second extent, the second reverser tab being removably coupled to the nozzle head and a degree of nozzle head rotation being adjustable between the first extent and the second extent dependent upon positioning of the second reverser tab.

* * * * *